US010415270B2

(12) United States Patent
Lowe et al.

(10) Patent No.: US 10,415,270 B2
(45) Date of Patent: Sep. 17, 2019

(54) HIGH SECURITY ELECTROCHEMICAL LOCK

(71) Applicant: SARGENT & GREENLEAF, INC., Nicholasville, KY (US)

(72) Inventors: Tommy O. Lowe, Lexington, KY (US); Daniel R. Gagnon, Harrodsburg, KY (US); Tarik S. Aweimrin, Lexington, KY (US); George M. Horne, Kannapolis, NC (US)

(73) Assignee: Sargent & Greenleaf, Inc., Nicholasville, KY (US)

( * ) Notice: Subject to any disclaimer, the term of this patent is extended or adjusted under 35 U.S.C. 154(b) by 0 days.

(21) Appl. No.: 15/579,817

(22) PCT Filed: May 26, 2016

(86) PCT No.: PCT/US2016/034323

§ 371 (c)(1),
(2) Date: Dec. 5, 2017

(87) PCT Pub. No.: WO2016/196192

PCT Pub. Date: Dec. 8, 2016

(65) Prior Publication Data

US 2018/0155960 A1 Jun. 7, 2018

Related U.S. Application Data

(60) Provisional application No. 62/171,880, filed on Jun. 5, 2015.

(51) Int. Cl.
*E05B 47/00* (2006.01)
*E05B 47/06* (2006.01)
(Continued)

(52) U.S. Cl.
CPC ..... *E05B 47/0607* (2013.01); *E05B 47/0012* (2013.01); *E05B 49/00* (2013.01);
(Continued)

(58) Field of Classification Search
None
See application file for complete search history.

(56) References Cited

U.S. PATENT DOCUMENTS 6,741,160 B1 5/2004 Dawson et al.
7,932,810 B2 * 4/2011 Gartner ..... G07C 9/00142 340/5.1

(Continued)

FOREIGN PATENT DOCUMENTS

EP 0712983 A2 5/1996
EP 2615407 B1 7/2017

OTHER PUBLICATIONS

EP Search Report dated Dec. 11, 2018 issued in corresponding EP Application No. 16804063.2.

*Primary Examiner* — K. Wong
(74) *Attorney, Agent, or Firm* — Baker & McKenzie LLP

(57) ABSTRACT

A high security electromechanical lock has a lock assembly configured to extend or retract a locking member. The lock assembly includes a first microcontroller communicatively coupled to an electronic storage memory. An electronic key input assembly is electrically and mechanically coupled to the lock assembly. The electronic key input assembly includes an electronic dial ring base having a base plate and a communications hub circuit. The base plate has a side wall. The communications hub circuit has a plurality of communications ports arranged around a periphery of the base plate that are accessible through the side wall. Each of the plurality of communications ports is configured to communicate with a respective peripheral electronic device of a plurality of peripheral electronic devices. The base plate is
(Continued)

configured to mechanically removably mount each of the plurality of peripheral electronic devices around the periphery of the side wall of the base plate.

49 Claims, 10 Drawing Sheets

(51) Int. Cl.
*E05B 49/00* (2006.01)
*G07C 9/00* (2006.01)

(52) U.S. Cl.
CPC ..... *G07C 9/00912* (2013.01); *G07C 9/00944* (2013.01); *E05B 2047/0017* (2013.01); *E05B 2047/0054* (2013.01); *E05B 2047/0058* (2013.01); *E05B 2047/0071* (2013.01); *E05B 2047/0088* (2013.01); *G07C 9/0069* (2013.01)

(56) References Cited

U.S. PATENT DOCUMENTS

| | | | | |
|---|---|---|---|---|
| 8,339,261 | B1 | 12/2012 | Wolski | |
| 9,984,524 | B2 * | 5/2018 | Fares | G07C 1/10 |
| 2007/0056339 | A1 * | 3/2007 | Irgens | E05B 49/00 70/312 |
| 2014/0109633 | A1 | 4/2014 | Romero | |
| 2016/0298362 | A1 * | 10/2016 | Gartner | E05B 47/026 |

* cited by examiner

HIGH SECURITY ELECTROCHEMICAL LOCK

CROSS-REFERENCE TO RELATED APPLICATIONS

This application claims priority to U.S. Provisional Patent Application No. 62/171,880 filed Jun. 5, 2015, which is incorporated herein by reference in its entirety.

TECHNICAL FIELD

The present invention relates to an electronic lock, and, more particularly, to a high security electromechanical lock.

BACKGROUND ART

A typical high security electromechanical lock includes a keypad and a lock. The keypad is mounted external to a container to which access is to be limited, and the lock is mounted internal to the container. In one application, for example, the container may be a safe. The keypad has connections to drive an analog signal to the lock, and includes logic to determine which button was pressed on the keypad. In many applications, such a lock and keypad is battery powered. Also, such lock controls are fixed in function at the time of installation on the container, and do little to promote power efficiency.

What is needed in the art is a high security electromechanical lock based on a digital platform which is expandable to support the installation of one or more auxiliary devices for communication with the lock electronic components, which simplifies battery replacement, and/or which is power efficient to extend battery life.

SUMMARY OF INVENTION

The present invention provides a high security electromechanical lock based on a digital platform which is expandable to support the installation of one or more auxiliary devices for communication with the lock electronic components. In addition, the present invention may also provide a configuration that simplifies battery replacement. Further, the present invention may also provide a lock system that is power efficient so as to extend battery life. Those skilled in the art will recognize that each of these provisions of the invention may be practiced alone, or in various combinations, in applications of the invention.

The invention in one form is directed to a high security electromechanical lock having a lock assembly configured to extend or retract a locking member. The lock assembly includes a first microcontroller communicatively coupled to an electronic storage memory. An electronic key input assembly is electrically and mechanically coupled to the lock assembly. The electronic key input assembly includes an electronic dial ring base having a base plate and a communications hub circuit mounted to the base plate. The base plate has a side wall. The communications hub circuit has a plurality of communications ports arranged around a periphery of the base plate that are accessible through the side wall. Each of the plurality of communications ports is configured to communicate with a respective peripheral electronic device of a plurality of peripheral electronic devices. The base plate is configured to mechanically removably mount each of the plurality of peripheral electronic devices around the periphery of the side wall of the base plate.

The invention in another form is directed to a high security electromechanical lock having a lock assembly configured to extend or retract a locking member. An electronic key input assembly is electrically and mechanically coupled to the lock assembly. The electronic key input assembly includes a main body and a bezel mounted to the main body. The bezel is configured to rotate about an operational axis when the bezel is in an axially retracted position relative to the main body to actuate the lock assembly and is configured for axial movement along the operational axis relative to the main body when the bezel is in a first rotational position relative to the main body to expose a battery receptacle formed in the main body.

The invention in another form is directed to a high security electromechanical lock having a lock assembly configured to extend or retract a locking member. The lock assembly includes a first microcontroller communicatively coupled to an electronic storage memory. The lock assembly is configured for data communications via a standard communications protocol as a target communications device. An electronic key input assembly is electrically and mechanically coupled to the lock assembly. The electronic key input assembly includes an electronic dial ring base, a main body, a bezel, a user interface, and an electrical controller circuit board. The electronic dial ring base has a base plate and a communications hub circuit mounted to the base plate. The main body is coupled to the electronic dial ring base. The bezel is mounted to the main body. The bezel is configured to rotate about an operational axis relative to the main body to actuate the lock assembly. The user interface is coupled to the main body. The electrical controller circuit board is mounted to the main body. The electrical controller circuit board is configured for data communications via the standard communications protocol as a communications host and is communicatively coupled to the user interface. The electrical controller circuit board includes a second microcontroller and a communications control circuit configured to direct bi-directional communication traffic with the first microcontroller of the lock assembly and with each of the second microcontroller and the communications hub circuit of the electronic key input assembly. The communications host and the target communications device are configured to communicate with each other via a standard communications connection compatible with the standard communications protocol. The communications host and the target communications device are configured to suspend communication during a standby mode for low power consumption, and are configured such that either or both of the communications host and the target communications device can enter the standby mode until a wakeup is triggered by either of the communications host and the target communications device.

BRIEF DESCRIPTION OF DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate an embodiment of the invention and such exemplifications are not to be construed as limiting the scope of the invention in any manner.

DESCRIPTION OF EMBODIMENTS

Figure 1:
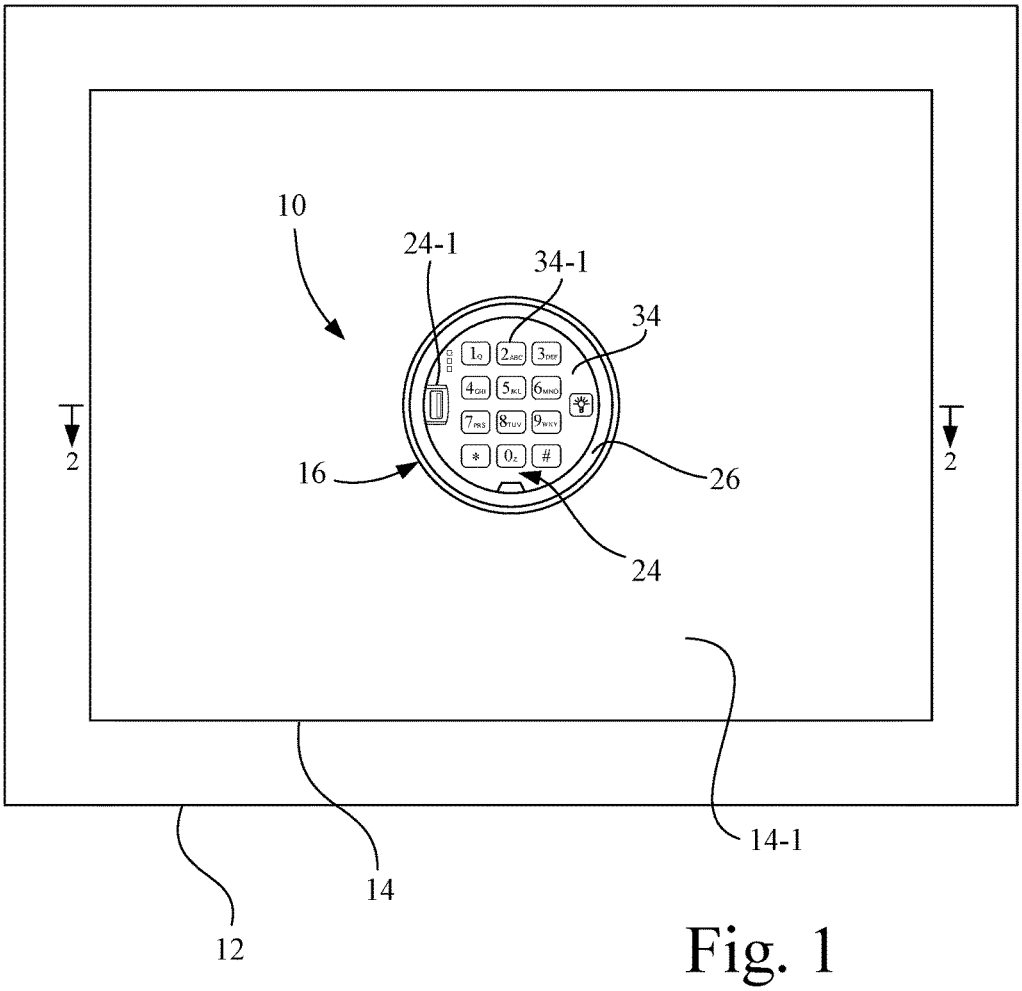
FIG. 1 is a front view of a container, such as a safe, having an electromechanical lock in accordance with the present invention.
Figure 2:
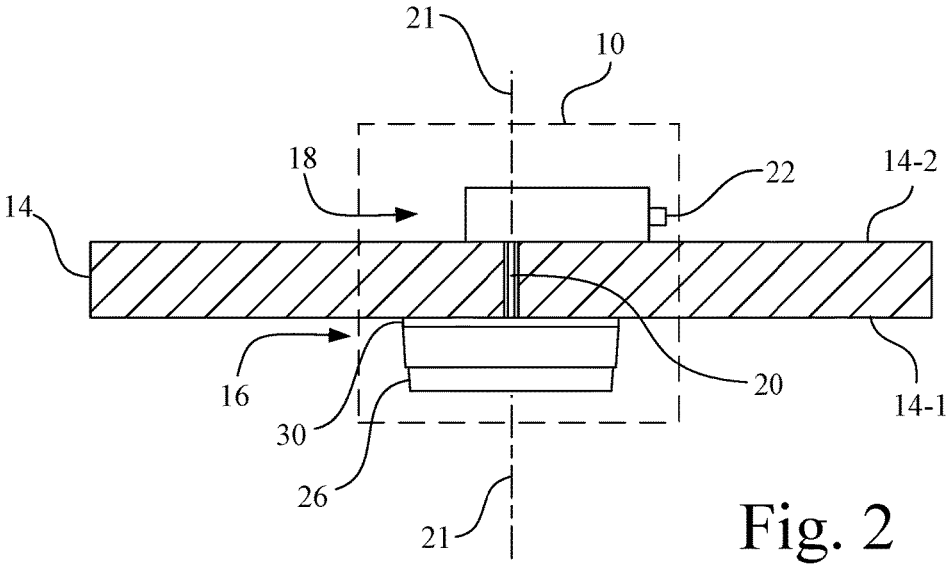
FIG. 2 is a sectional view of the door of FIG. 1 taken along line 2-2, showing both the exterior electronic key input assembly and the interior lock assembly.

Referring now to the drawings and particularly to FIGS. 1 and 2, there is shown a high security electromechanical lock 10, in accordance with the present invention, mounted to a container 12, e.g., a safe, having a door 14, to which interior access is to be limited.

Electromechanical lock 10 is based on a digital keypad/lock platform, and includes an electronic key input assembly 16, such as a keypad assembly, that is electrically and mechanically coupled to a lock assembly 18. Electronic key input assembly 16 is mounted external to container 12, such as on an external surface 14-1 of door 14, and lock assembly 18 is mounted internal to container 12, such as on an interior surface 14-2 of door 14. Electronic key input assembly 16 is mechanically operably coupled to lock assembly 18 via a spindle 20 configured to rotate about an operational axis 21 to selectively operate, e.g., retract, a latch/bolt drive 22 of lock assembly 18, once an authenticated key entry has been received at electronic key input assembly 16. Latch/bolt drive 22 is configured to extend (for a lock condition) or retract (for an unlock condition) a locking member, such as a latch or bolt, as is well known in the art. Latch/bolt drive 22 may be a mechanical gear arrangement driven by spindle 20, and/or may include a motor or solenoid arrangement.

Figure 3:
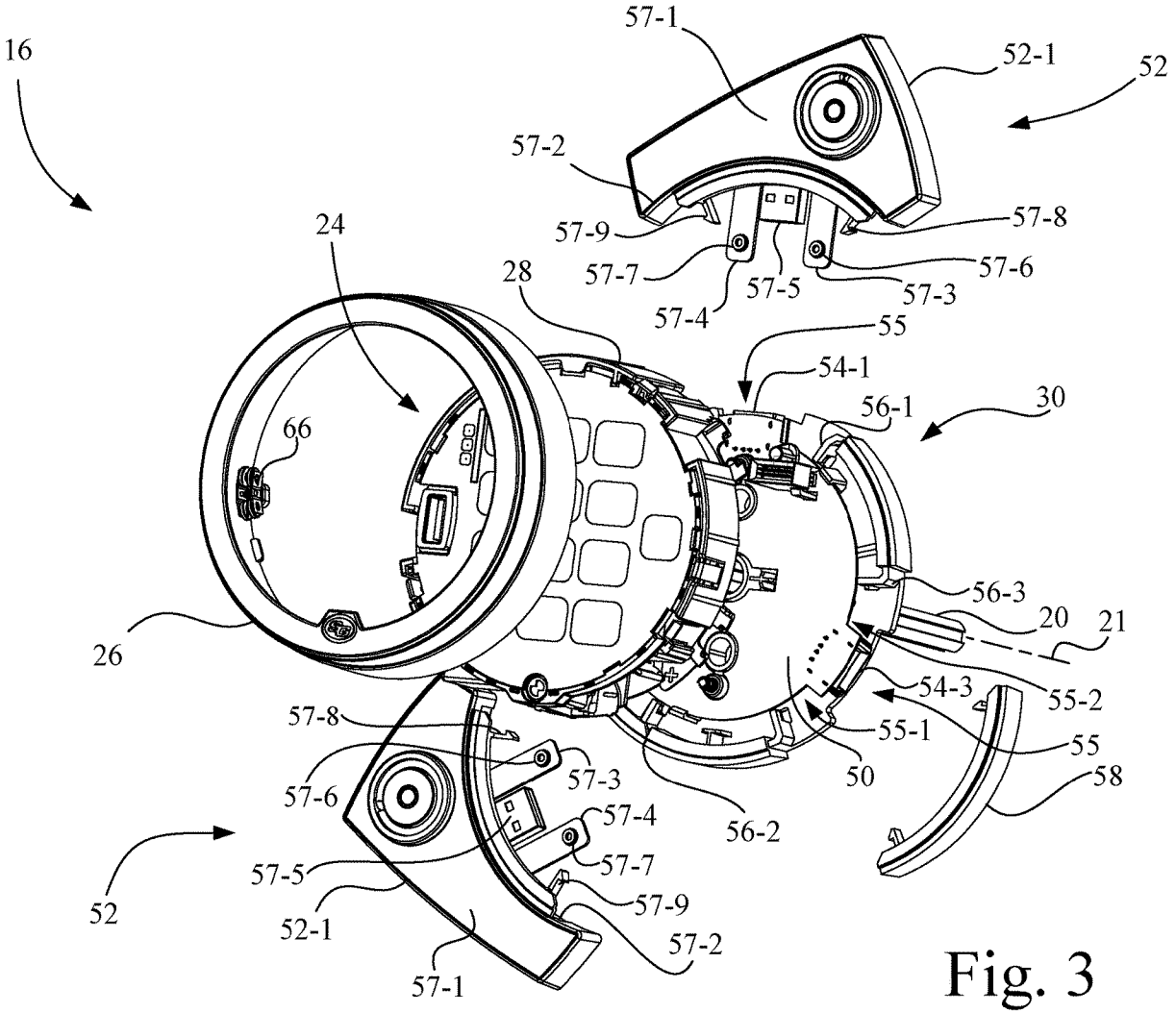
FIG. 3 is an exploded view in perspective of the electronic key input assembly of FIGS. 1 and 2, showing the bezel, the main body, the electronic dial ring base, and two removable peripheral devices.
Figure 4A:
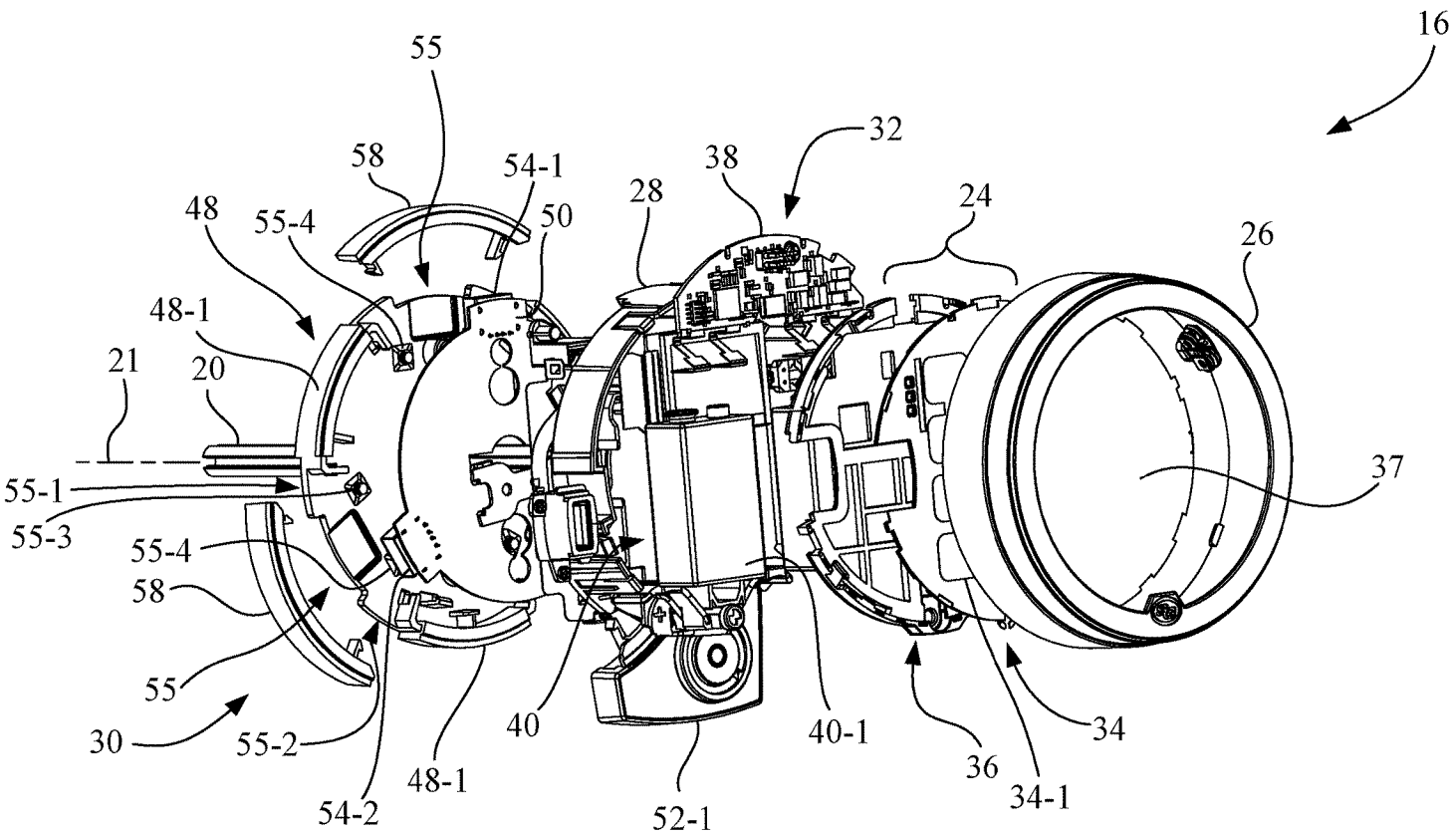
FIG. 4A is a further exploded view in perspective of the electronic key input assembly of FIGS. 1-3.
Figure 4B:
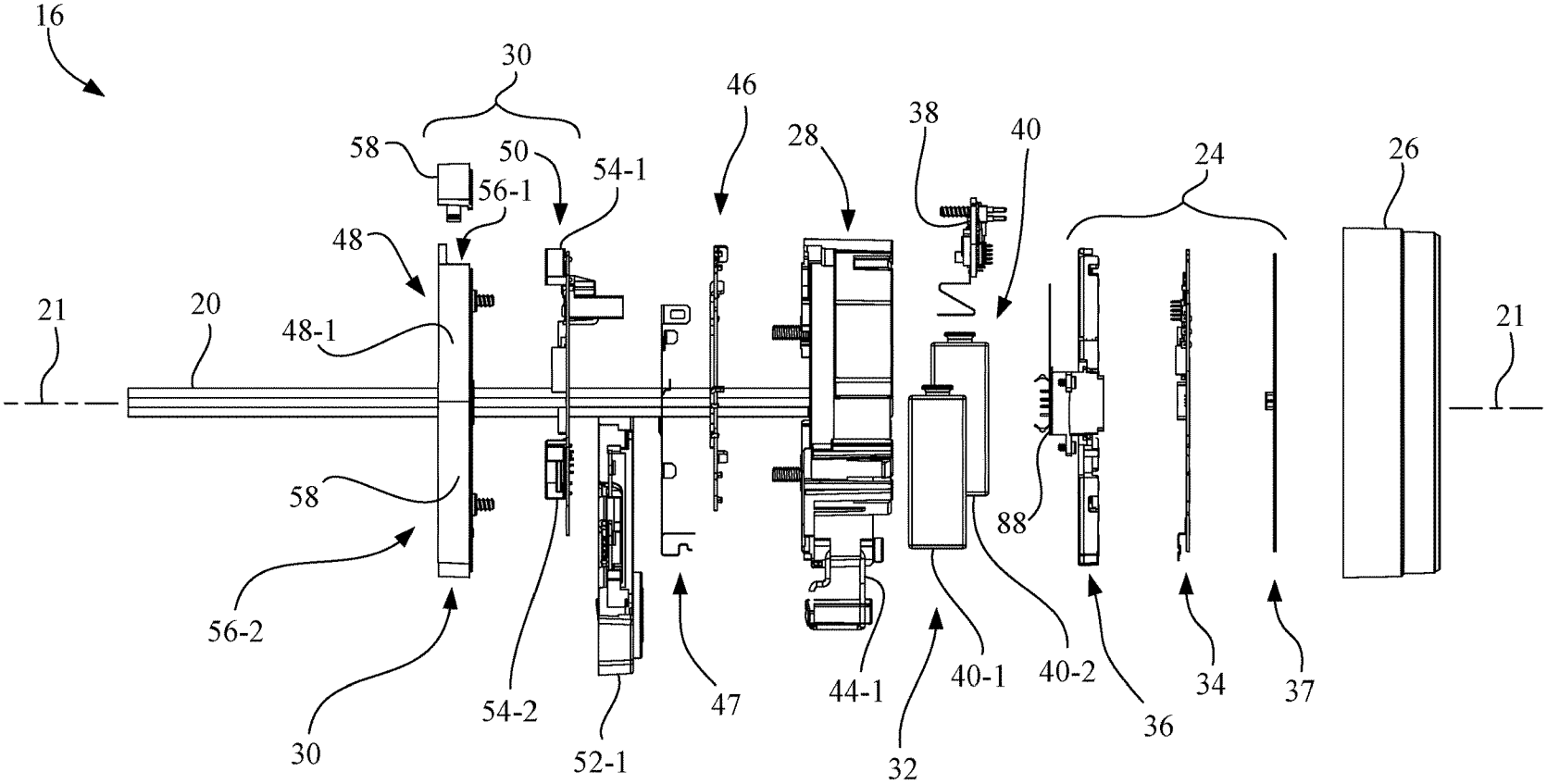
FIG. 4B is a further exploded side view of the electronic key input assembly of FIGS. 1-3.

Referring also to FIGS. 3, 4A, and 4B, in the present embodiment, electronic key input assembly 16 includes a user interface 24, a bezel 26, a main body 28, an electronic dial ring base 30, and a direct current (DC) power supply 32. Electronic dial ring base 30 is configured to be mounted to container 12, such as external surface 14-1 of door 14. Main body 28 is in turn mounted to electronic dial ring base 30. Each of user interface 24 and bezel 26 is mounted to main body 28.

In the present exemplary embodiment, user interface 24 is in the form of a keypad, and includes a touch plate assembly 34 and an electrical controller circuit board 36. Touch plate assembly 34 may optionally include a transparent protective cover 37 (see FIG. 4A). In part, user interface 24 is a user interface and may be configured as a traditional touch sensitive code entry device for receiving user codes and commands via numerical or alpha-numeric touch buttons. The functionality of user interface 24 may be further expanded by inclusion of a display screen, such as an LCD touchscreen display configured to receive user inputs (e.g., an authorized lock actuation code) and/or provide visual output to the user.

Figure 5:
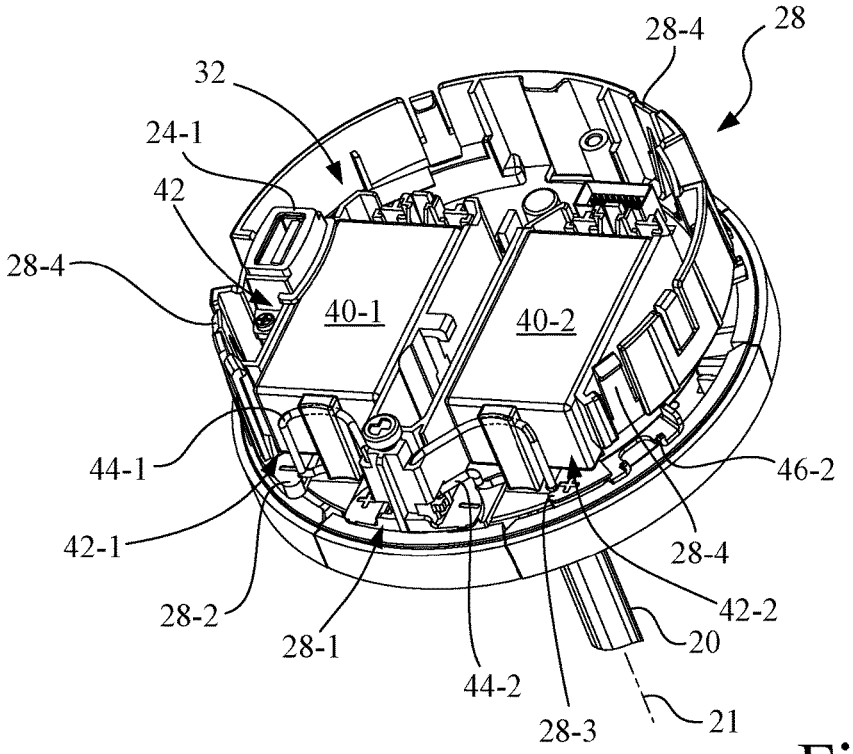
FIG. 5 is a front perspective view of the main body of the electronic key input assembly of FIGS. 3-4B, depicting the battery receptacle with batteries installed.

DC power supply 32 is configured to provide electrical power to electronic key input assembly 16 and to lock assembly 18. DC power supply 32 includes a power regulation/distribution printed circuit board 38 that is electrically connected to a DC power source 40. Referring also to FIG. 5, DC power source 40 may be, for example, batteries 40-1, 40-2 of approximately "C" size. Each of battery 40-1 and battery 40-2 maybe an individual battery, or may be formed as a battery pack containing multiple batteries.

Referring also to FIG. 5, main body 28 is configured to mount DC power supply 32. Main body 28 includes a battery receptacle 42 configured to contain DC power source 40, and in the present configuration, battery receptacle 42 is provided with two battery chambers 42-1, 42-2, each of which holds a respective battery 40-1, 40-2 of DC power source 40, of approximately "C" battery physical size. The two battery chambers 42-1, 42-2 are oriented side-by-side, in parallel, and are separated by a dividing wall 28-1. Positioned at a proximal end of each of battery chamber 42-1 and battery chamber 42-2 is a battery retention clip 44-1 and a battery retention clip 44-2, respectively, which serves as a door to radially retain the respective battery in the respective battery chambers 42-1, 42-2. Each of battery retention clip 44-1, 44-2 is pivotably mounted to a proximal end of dividing wall 28-1, and battery retention clips 44-1, 44-2 are configured to open in opposite directions, e.g., battery retention clip 44-1 is configured as a right-hand open and battery retention clip 44-2 is configured as a left-hand open.

Each of battery retention clip 44-1, 44-2 may be formed of a continuous length of wire, bent to form two arcuate portions joined at their respective distal ends by a straight connecting portion, and with the two proximal free ends being bent in opposing directions to form a pair of axially arranged rotational axles, which are received in corresponding pivot openings formed at the proximal end of dividing wall 28-1. The two arcuate portions of each battery retention clip 44-1, 44-2 are configured to engage a proximal end of the respective battery 40-1, 40-2, and the arcuate portion closest to a floor of the main body 28 engages a respective latch 28-2, 28-3 formed in the floor of the main body 28 to retain the respective battery 40-1, 40-2 in the respective battery chamber 42-1, 42-2.

Figure 6:
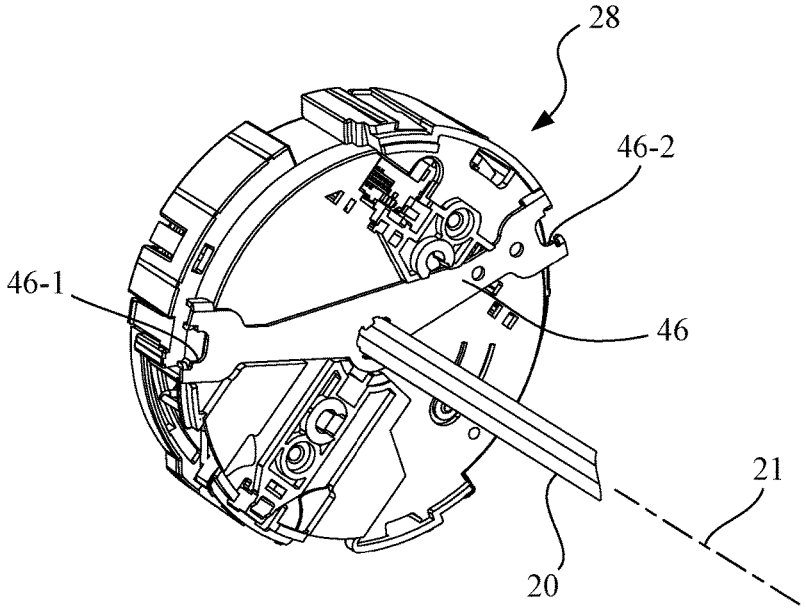
FIG. 6 is a rear perspective view of the main body of the electronic key input assembly of FIGS. 3-4B, showing the spindle drive plate rotatably coupled to the main body.

Referring also to FIG. 6, a drive plate 46, serving as a rotatable spindle drive, is interposed between main body 28 and electronic dial ring base 30. Drive plate 46 is rotatably attached to main body 28 by a retainer plate 47. Drive plate 46 is, in turn, rotatably coupled to latch/bolt drive 22 (also sometimes referred to as the lock works) of lock assembly 18 by spindle 20. Thus, a rotation of drive plate 46 moves the bolt works in lock assembly 18 via spindle 20.

Referring again to FIGS. 3, 4A and 4B, electronic dial ring base 30 includes a base plate 48 and a USB hub circuit board 50 serving as a communications hub. Electronic dial ring base 30 is configured to electrically and mechanically mount a plurality of peripheral electronic devices 52 around the periphery of a side wall 48-1 of base plate 48 of electronic dial ring base 30. In the present configuration, USB hub circuit board 50 of electronic dial ring base 30 includes a plurality of USB ports 54-1, 54-2, 54-3 that are accessible through a corresponding plurality of side windows 56-1, 56-2, 56-3 formed in a side wall 48-1 of electronic dial ring base 30. More particularly, the present configuration includes multiple USB ports located at equal angular increments (e.g., three USB ports 54-1, 54-2, 54-3 at 120 degree increments in the present embodiment to accommodate three peripheral electronic devices, or four USB ports at 90 degree increments to accommodate four peripheral electronic devices) around the periphery of the side wall 48-1 of electronic dial ring base 30. One or more of side windows 56-1, 56-2, 56-3 may be blocked, i.e., covered, by a respective annular cover clip 58 having a pair of mounting tabs, e.g., a pair of elongate catch latches, which are arranged to engage the lateral walls of a respective one of side windows 56-1, 56-2, 56-3 and deflect when inserted into the window so as to releasably hold and retain the cover clip 58 in position in the respective side window 56-1, 56-2, 56-3 on electronic dial ring base 30.

Those skilled in the art will recognize that the principles described above with respect to USB communications may also be applied to other communication schemes, such as those that utilize 4-wire UART communication.

Referring to FIG. 3, one or more of peripheral electronic devices 52 may be configured to mechanically mount directly to electronic dial ring base 30. Electronic dial ring base 30 includes multiple sets of peripheral device mounting receptacles 55 located at each USB port. In particular, each peripheral device mounting receptacle 55 includes a pair of tab receiver slots 55-1, 55-2. Tab receiver slot 55-1 is laterally spaced from tab receiver slot 55-2, with a respective one of USB ports 54-1, 54-2, 54-3 being interposed between the pair of tab receiver slots 55-1, 55-2. Referring to FIG. 4A, at the end of each tab receiver slot 55-1, 55-2 is a retention bump 55-3, 55-4 that protrudes upwardly from the slot surface, each of which having a screw hole for optionally receiving a screw.

As best shown in FIG. 3, each peripheral electronic device 52 to be directly mounted to electronic dial ring base 30 includes a housing 57-1 having an arcuate portion 57-2 corresponding in shape to the arcuate periphery of side wall 48-1 of base plate 48 of electronic dial ring base 30. A pair of laterally spaced elongate tabs 57-3, 57-4 extends outwardly away from arcuate portion 57-2, and is configured to longitudinally mechanically engage the pair of tab receiver slots 55-1, 55-2 of electronic dial ring base 30. Interposed between the laterally spaced elongate tabs 57-3, 57-4 is a USB connector 57-5. Each peripheral electronic device 52 includes a pair of laterally spaced latch members 57-8, 57-9, e.g., a pair of elongate catch latches, which are arranged to engage the lateral walls of a respective one of side windows 56-1, 56-2, 56-3, so as to releasably hold peripheral electronic device 52 in the respective side window 56-1, 56-2, 56-3 of electronic dial ring base 30. Also, each of elongate tabs 57-3, 57-4 includes a retention opening 57-6, 57-7 near the distal free end of the respective elongate tab 57-3, 57-4 which is configured to optionally receive a retention screw through a respective retention bump 55-3, 55-4 (see FIG. 4A) of tab receiver slot 55-1, 55-2 of base plate 48 to releasably, but fixedly, hold peripheral electronic device 52 in the respective side window 56-1, 56-2, 56-3 of electronic dial ring base 30.

Each of elongate tabs 57-3, 57-4 is configured from a rigid material, such as flat metal stock, so as to resist both torsional forces around operational axis 21 and axial forces in the direction of the extent of operational axis 21. Each of the pair of laterally spaced latch members 57-8, 57-9 is configured to deflect at its free end to aid in the installation and removal of the peripheral electronic device 52 from electronic dial ring base 30.

In accordance with an aspect of the present invention, with reference to FIGS. 1-12B, bezel 26 and main body 28 are configured to facilitate both axial and rotational movement of bezel 26 relative to main body 28 with respect to operational axis 21. Axial movement of bezel 26 relative to main body 28 along operational axis 21 allows access to batteries 40-1, 40-2 contained in battery chambers 42-1, 42-2 of battery receptacle 42. Rotational movement of bezel 26 relative to main body 28 about operational axis 21 rotates drive plate 46, i.e., to rotatably drive spindle, to in turn operate latch/bolt drive 22, including a linear bolt or pivot bolt, of lock assembly 18.

Figure 7:
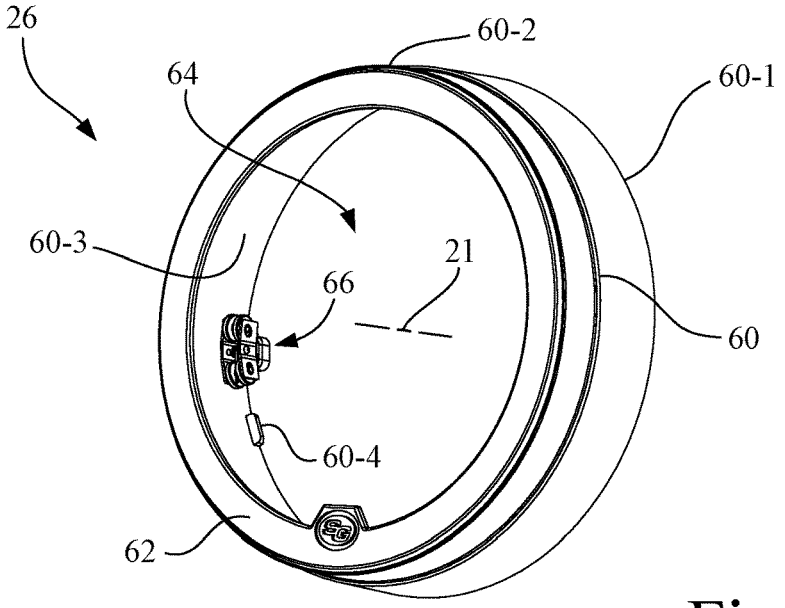
FIG. 7 is a front perspective view of the bezel of the electronic key input assembly of FIGS. 3-4B.

Referring to FIGS. 3, 4A and 7, bezel 26 is configured as a rigid ring, which may be made from plastic or metallic materials, depending on aesthetic preference. Bezel 26 includes an annular side wall 60 and an annular inwardly facing lip 62. Annular side wall 60 has a distal annular edge 60-1 and a proximal annular edge 60-2. Distal annular edge 60-1 defines a distal opening that is sized to receive electronic key input assembly 16 and main body 28. Proximal annular edge 60-2 transitions into annular inwardly facing lip 62. Annular inwardly facing lip 62 defines a viewing window 64 for user interface 24. User interface 24 is positioned between bezel 26 and main body 28, with annular inwardly facing lip 62 covering over a perimetrical portion of user interface 24.

Figure 8:
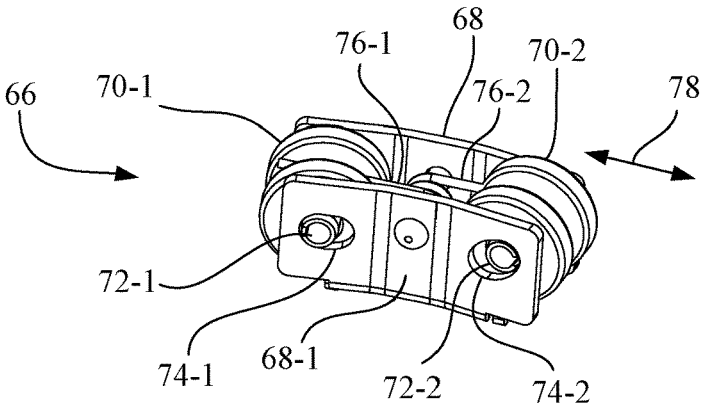
FIG. 8 is an enlarged perspective view of an interior roller assembly of the bezel of FIG. 7.

Referring to FIGS. 7 and 8, attached to an interior surface 60-3 of annular side wall 60 of bezel 26 is one or more roller assemblies 66. Each roller assembly 66 serves as a bearing and a connection with main body 28 of electronic key input assembly 16. As best shown in FIG. 8, each roller assembly 66 includes a roller carrier body 68 in the form of a yoke in which a pair of rollers 70-1, 70-2 is rotatably and flexibly mounted. Roller carrier body 68 may be attached to, or formed integrally with, the interior surface 60-3 of annular side wall 60 of bezel 26.

Roller 70-1 of the pair of rollers 70-1, 70-2 is mounted to an axle 72-1. Likewise, roller 70-2 of the pair of rollers 70-1, 70-2 is mounted to an axle 72-2. Opposing ends of the axle 72-1 are respectively received in a pair of opposed slotted openings 74-1 in roller carrier body 68. Opposing ends of the axle 72-2 are respectively received in a pair of opposed slotted openings 74-2 in roller carrier body 68. Each roller is spring loaded (biased) outwardly from a radial center 68-1 of roller carrier body 68 by a respective spring 76-1, 76-2 (e.g., opposed ends of a torsion spring), such that the pair of rollers 70-1, 70-2 are flexible in directions 78 about the annular interior periphery of bezel 26, such as in an annular angular range at a location radially spaced from operational axis 21, e.g., in the vertical radial directions about operational axis 21.

Figure 9:
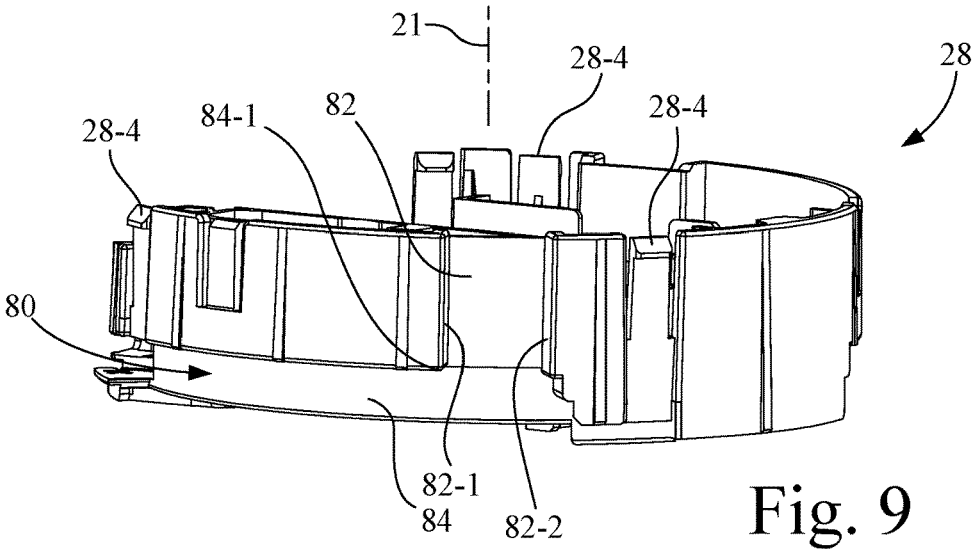
FIG. 9 is a side view of the main body of the electronic key input assembly of FIGS. 3-5, showing the guide channel in which the roller assembly of FIG. 8 rides.

Referring to FIG. 9, main body 28 of electronic key input assembly 16 may be made from a variety of materials, such as plastic or metal, which may allow some degree of flexibility on certain features and provide a rigid bearing surface for roller assemblies 66. Main body 28 includes, for each roller assembly 66, at its periphery an exterior guide channel 80 where the rollers 70-1, 70-2 of roller assembly 66 ride, thus limiting the allowable axial and rotational motion of bezel 26 and roller assembly 66 relative to main body 28.

In particular, each guide channel 80 in profile has an L-shape, and includes an axial channel portion 82 and an annular channel portion 84, each of which is radially spaced from operational axis 21. Axial channel portion 82 has an axial extent that is substantially parallel to operational axis 21, and is located at an open end 84-1 of the annular channel portion 84, wherein axial channel portion 82 is continuous with annular channel portion 84. As used herein, the term substantially parallel means a range of parallel, plus or minus 10 degrees.

Figure 10:
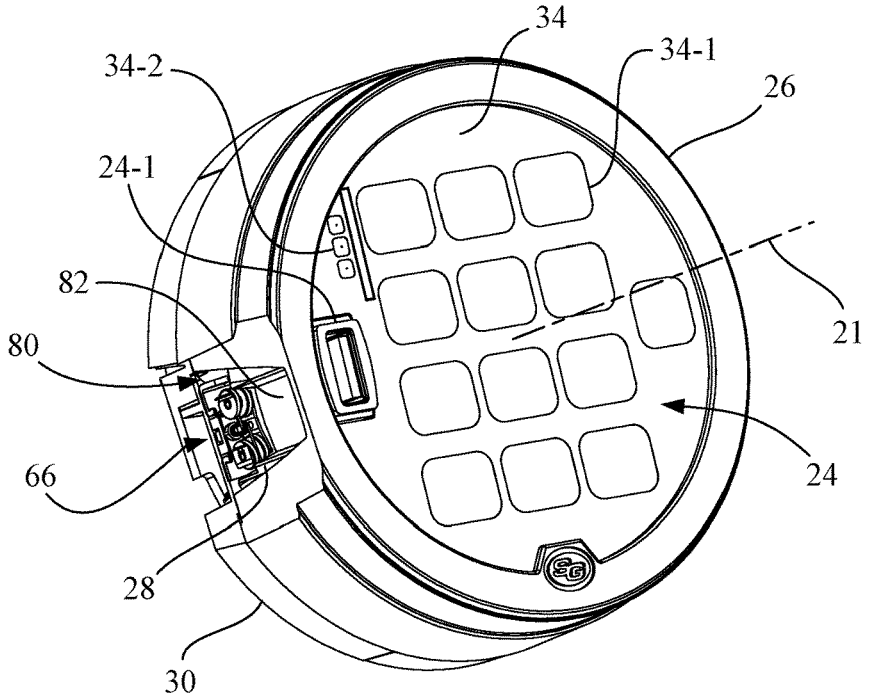
FIG. 10 is a perspective view of the electronics key input assembly of FIGS. 3-4B, showing the bezel in an axially retracted position, relative to the main body, with the bezel in the home (fully counterclockwise, rest) position, and with a portion broken away to expose one of the roller assemblies in relation to the respective guide channel of the main body.
Figure 11:
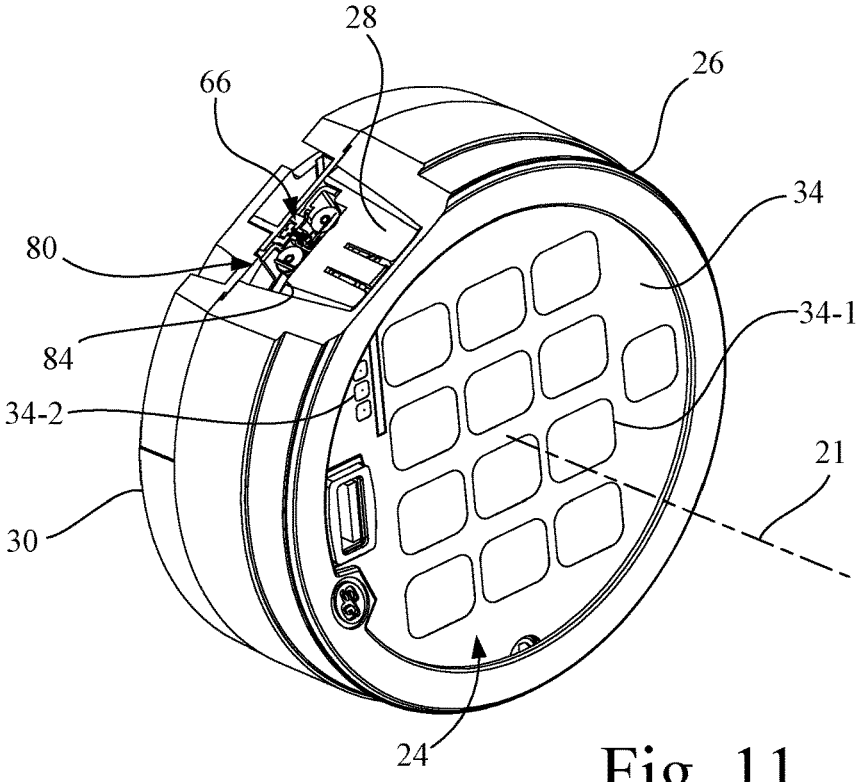
FIG. 11 is a perspective view of the electronics key input assembly of FIGS. 3-4B, showing the bezel in an axially retracted position, relative to the main body, with the bezel rotated clockwise to actuate the lock assembly of FIG. 1, and with a portion broken away to expose one of the roller assemblies in relation to the guide channel of the main body.
Figure 12A:
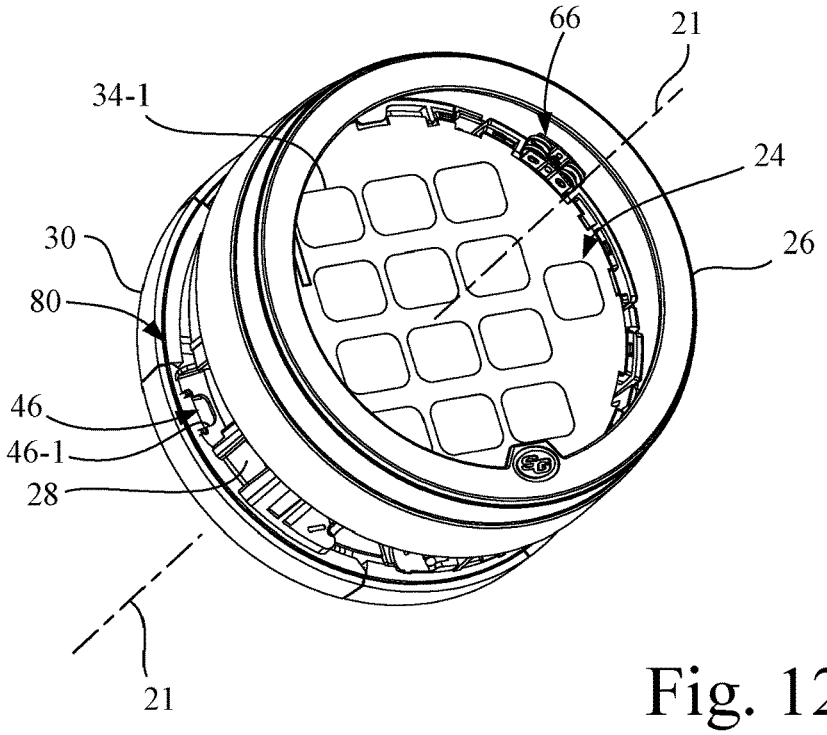
FIGS. 12A and 12B show perspective views of the electronics key input assembly of FIGS. 3-4B, showing the bezel rotationally in a fully counterclockwise position and with the bezel in an axially extended position, relative to the main body, with one of the battery retention clips rotated outwardly to facilitate removal of the respective battery from the respective battery chamber.
Figure 12B:
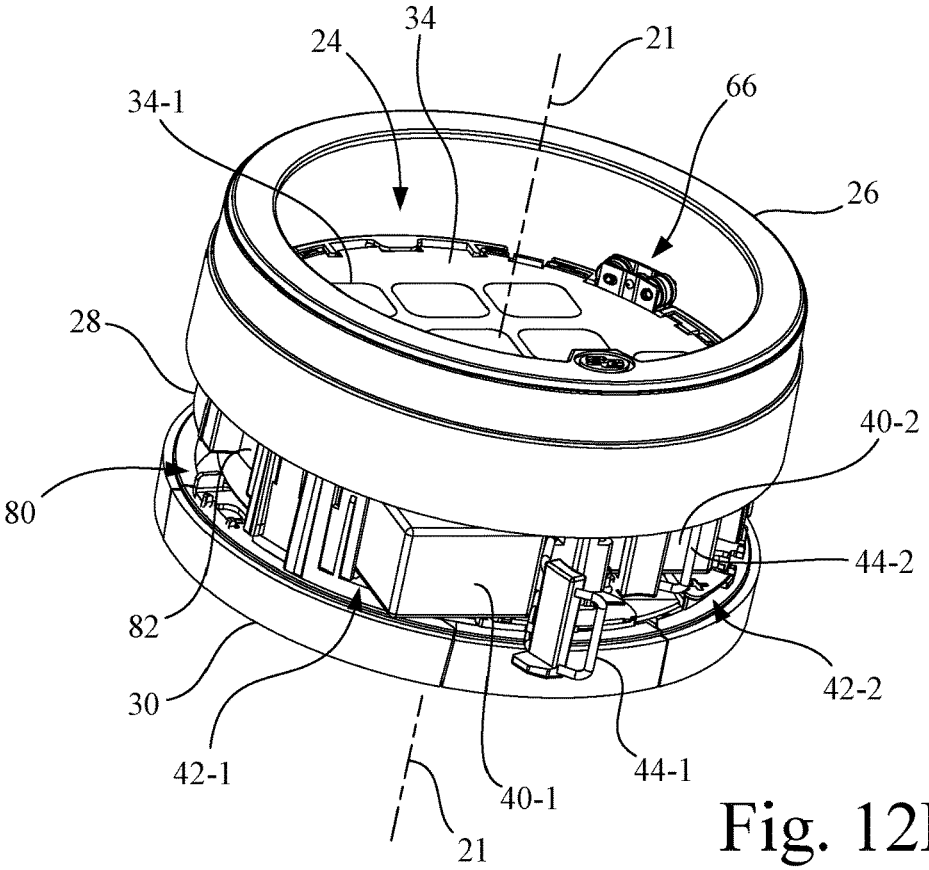

Referring also to FIGS. 10-12B, FIGS. 10 and 11 show bezel 26 in an axially retracted position, with FIG. 10 showing the bezel in the fully counterclockwise home (rest) position and with FIG. 11 showing the bezel 26 rotated clockwise to actuate lock assembly 18. FIGS. 12A and 12B show bezel 26 in an axially extended position, relative to main body 28, and with respect to the axial extent of operational axis 21, achievable only when bezel 26 is in the fully counterclockwise position of FIG. 10 prior to initiating axial movement of bezel 26.

In the present configuration, and with reference to FIGS. 10A and 10B, axial movement of bezel 26 relative to main body 28 is permitted only when roller assembly 66 of bezel 26 is in axial alignment with axial channel portion 82, i.e., rotated in a counterclockwise direction away from the open end 84-1 of the annular channel portion 84. Thus, in the configuration shown, bezel 26 must be in its counterclockwise-most rotational position (FIG. 10) in order for roller assembly 66 of bezel 26 to axially align the respective pair of rollers 70-1, 70-2 with axial channel portion 82 of guide channel 80 of main body 28, and thus permit and facilitate movement of bezel 26 along operational axis 21, by a force applied by the user, from the axially retracted position depicted in FIGS. 10 and 11 toward the axially extended position depicted in FIGS. 12A and 12B. Referring also to FIGS. 7 and 9, when bezel 26 is in the axially extended position depicted in FIGS. 12A and 12B, tabs 60-4 on interior surface 60-3 adjacent to distal annular edge 60-1 of bezel 26 are positioned to engage the catches on the free ends of the corresponding elongate catch tabs 28-4 of main body 28 to define the axial extent of the axially extended position. Catch tabs 28-4 also serve to prevent removal of bezel 26 from main body 28 until catch tabs 28-4 are deflected inwardly toward operational axis 21.

Referring also to FIG. 9, axial channel portion 82 has a pair of opposed axially extending side walls 82-1, 82-1, further identified as inner axial side wall 82-1 and outer axial side wall 82-2. Inner axial side wall 82-1 and outer axial side wall 82-2 are spaced to inwardly collapse the pair of rollers 70-1, 70-2 (see also FIG. 8) of the respective roller assembly 66 as respective roller assembly 66 axially transitions into axial channel portion 82 of guide channel 80 (see also FIG. 10). By virtue of the biasing force exerted by spring 76-1, the pair of rollers 70-1, 70-2 expand when the pair of rollers 70-1, 70-2 are axially positioned beyond the axial extents of inner axial side wall 82-1 of the pair of opposed axially extending side walls 82-1, 82-2 of axial channel portion 82, with the pair of rollers 70-1, 70-2 remaining in contact with main body 28 to form a respective axial detent at each of the axially retracted position depicted in FIG. 10 and the axially extended position depicted in FIGS. 12A and 12B.

Referring again to FIGS. 9-11, annular channel portion 84 of guide channel 80 of main body 28 facilitates rotational movement of bezel 26 about operational axis 21, but only when bezel 26 is in the axially retracted position depicted in FIGS. 10 and 11 such that the pair of rollers 70-1, 70-2 of each respective roller assembly 66 of bezel 26 is rotationally aligned with the respective annular channel portion 84 of main body 28. In operation, drive plate 46 is rotated whenever bezel 26 is rotated by the user. During the initial movement of roller assemblies 66 along the respective side walls 82-1, 82-2 of axial channel portion 82, each roller assembly 66 disengages from drive plate 46 (see also FIG. 6), such that drive plate 46 is no longer drivably engaged with bezel 26 when bezel 26 is moved axially to the axially extended position depicted in FIGS. 12A and 12B. Thus, each bezel roller assembly 66 provides a releasable, i.e., breakable, connection with drive plate 46.

Referring to FIGS. 6 and 7, drive plate 46 is configured to be selectively engaged by bezel 26 when bezel 26 is in the retracted position depicted in FIGS. 10 and 11. When so engaged by bezel 26, a rotation of bezel 26 results in a corresponding rotation of drive plate 46, and in turn, a corresponding rotation of spindle 20. Referring also to FIG. 9, as bezel 26 is rotated, each roller assembly 66 of bezel 26 movably engages and is guided by a respective annular channel portion 84 of the guide channel 80 of main body 28. Once roller assembly 66 of bezel 26 movably engages the respective annular channel portion 84, axial movement of bezel 26 along operational axis 21 relative to main body 28 is restrained.

Referring to FIGS. 6 and 7, drive plate 46 includes one or more drive slots 46-1, 46-2 near the periphery of drive plate 46 that are configured to selectively receive a portion of a respective roller carrier body 68 of roller assembly 66 attached to bezel 26. Stated differently, each roller carrier body 68 of bezel 26 is configured to selectively engage a respective drive slot 46-1, 46-2 of drive plate 46 when bezel 26 is in the retracted position depicted in FIGS. 10 and 11.

Advantageously, the spring loading of bezel 26 makes for smooth operation with no clearance and no free wobbling of bezel 26 during operation. Also, by simply depressing catch tabs 28-4 (see FIG. 9) of main body 28 when bezel 26 is in the axially extended position (see FIG. 12B), bezel 26 easily may be removed and exchanged for a bezel having a different atheistic appearance, if desired.

Figure 13:
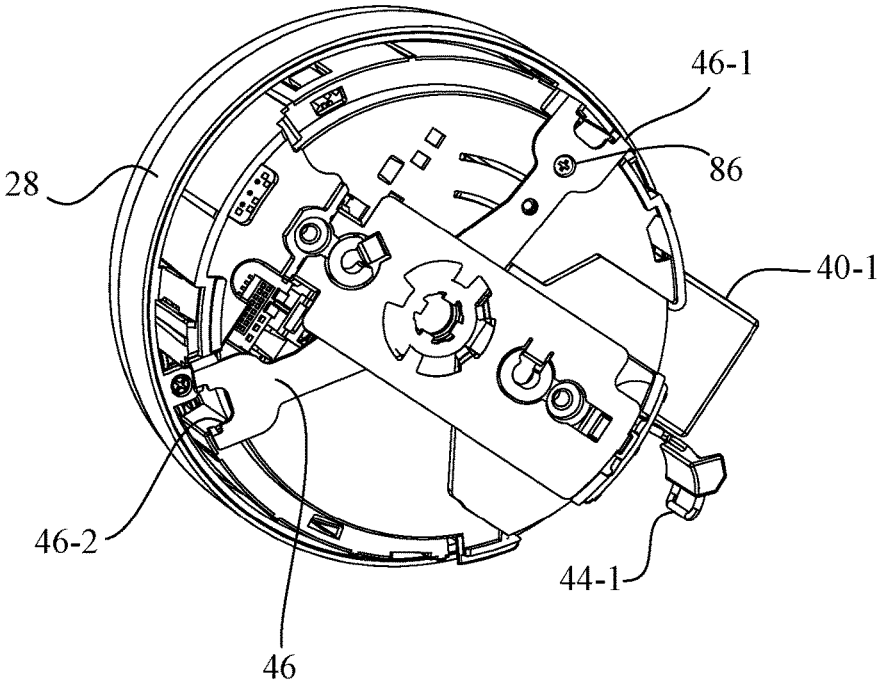
FIG. 13 is a rear perspective view of the electronic key input assembly of FIGS. 3-4B, showing the spindle drive plate locked in a permanent rotational position by a screw.

Referring to FIG. 13, in some instances, electronic key input assembly 16 may be used in locking applications where the movement of the lock works, e.g., latch/bolt drive 22, of lock assembly 18 is purely electronic/electrical (e.g., by having motor or solenoid bolt actuators), and thus no rotational movement of bezel 26 is required, or desired. In such a case, as depicted in FIG. 13, to prevent unintended rotational movement of bezel 26, and to make electronic key input assembly 16 feel more rigid to the user, a screw 86 may be inserted through one or both of drive slot 46-1 and drive slot 46-2 of drive plate 46 and into main body 28, thus locking drive plate 46 and bezel 26 to main body 28.

In accordance with another aspect of the invention, referring to FIGS. 3, 4A, 4B and 14, electronic key input assembly 16 is configured as an embedded digital platform system capable of communicating with lock assembly 18 via serial data communication, such as by using the universal serial bus (USB) protocol. Advantageously, the system may store data to a USB memory device and has a USB peripheral interface to provide the capability to connect to removable USB peripheral electronic devices 52, such as an iButton® Reader 52-1 available from iButtonLink Technologies, a USB biometric fingerprint scanner, a USB Bluetooth receiver, a USB Ethernet adapter, etc., as will be described in more detail below. The iButton® Reader 52-1 is configured to communicate with an iButton® smart card available from Dallas Semiconductor. The digital electronic key input assembly 16 can drive these user interface features while lock assembly 18 maintains the security, access control, and event tracking information securely in memory contained in lock assembly 18 inside of the locked container 12.

Figure 14:
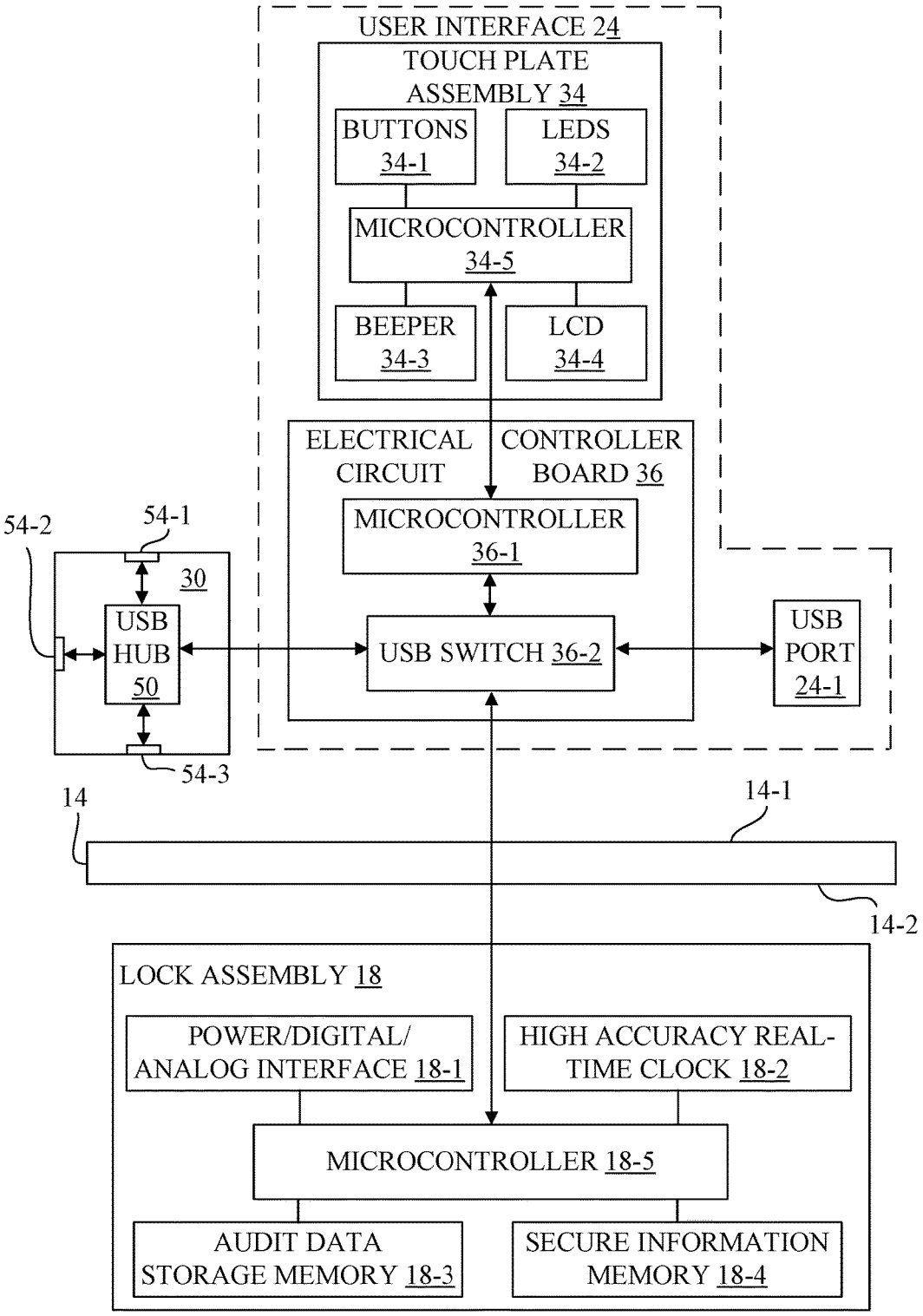
FIG. 14 is an electrical block diagram of the electromechanical lock system of the present invention.

FIG. 14 is an electrical block diagram of the electromechanical lock 10 of the present invention. As set forth above, user interface 24, e.g., configured as a keypad, includes touch plate assembly 34 which is electrically connected to electrical controller circuit board 36. User interface 24 is electrically connected to the electronics of electronic dial ring base 30 via a connection tower 88 (see FIG. 4B) formed on one of the electrical controller circuit board 36 of electronic key input assembly 16 or the electronic dial ring base 30. The connection tower 88 includes a plurality of connection pins arranged in a pattern to correspond to the electrical connector socket of the other component. Since main body 28 is interposed between the key pad and electronic dial ring base 30, main body 28 includes an opening through which connection tower 88 passes. Electrical controller circuit board 36 of user interface 24 is connected in electrical communication with each of electronic dial ring base 30, lock assembly 18, and a USB port 24-1 in the front face of user interface 24.

Touch plate assembly 34, in the present embodiment, includes numerical or alpha-numeric touch buttons 34-1, LEDs (as visual indicators) 34-2, a sound generator (beeper) 34-3, and optionally, an LCD display 34-4. Each of touch buttons 34-1, LED indicators 34-2, sound generator (beeper) 34-3, and LCD display 34-4 is communicatively coupled to a microcontroller 34-5. Microcontroller 34-5 includes a microprocessor and resident non-transitory electronic memory, such as random access memory (RAM), read only memory (ROM), electrically erasable read only memory (EEROM), and non-volatile RAM (NVRAM). Microcontroller 34-5 is configured to execute program instructions to read inputs received from touch buttons 34-1, and to provide electrical outputs to one or more of LED indicators 34-2, sound generator (beeper) 34-3, and/or LCD display 34-4. Microcontroller 34-5 is also configured to execute program instructions to facilitate bi-directional communications, e.g., using a serial communication protocol, such as USB, with electrical controller circuit board 36.

Electrical controller circuit board 36 of user interface 24 functions as a local USB host in the system of electromechanical lock 10. Electrical controller circuit board 36 includes a microcontroller 36-1 and a USB switch 36-2. Microcontroller 36-1 includes a microprocessor and resident non-transitory electronic memory, such as random access memory (RAM), read only memory (ROM), electrically erasable read only memory (EEROM), and non-volatile RAM (NVRAM). Microcontroller 36-1 is configured to execute program instructions to facilitate bi-directional communications using a serial communication protocol, such as USB, with touch plate assembly 34 and USB switch 36-2.

USB switch 36-2 is configured to operate using a serial communication protocol, such as USB, and directs bi-directional USB communication traffic between microcontroller 36-1 and each of USB hub circuit board 50 of electronic dial ring base 30, lock assembly 18, and the USB port 24-1 in the front face of user interface 24.

Lock assembly 18 includes a power/digital/analog interface 18-1, a high accuracy real-time clock 18-2, an audit data storage memory 18-3 and a secure information memory 18-4. Audit data storage memory 18-3 is used for storage of data associated with the usage of electromechanical lock 10, such as time/date, user identification, etc. Secure information memory 18-4 is used for storing secure information associated with electromechanical lock 10, such as user authentication data, e.g., valid key codes, and encryption data (if any).

Each of power/digital/analog interface 18-1, high accuracy real-time clock 18-2, audit data storage memory 18-3 and secure information memory 18-4 is communicatively coupled to a microcontroller 18-5. Microcontroller 18-5 includes a microprocessor and resident non-transitory electronic memory, such as random access memory (RAM), read only memory (ROM), electrically erasable read only memory (EEROM), and non-volatile RAM (NVRAM). Each of audit data storage memory 18-3 and a secure information memory 18-4 may be in the form of non-transitory electrical non-volatile memory, such as electrically erasable read only memory (EEROM) and/or non-volatile RAM (NVRAM).

Microcontroller 18-5 is configured to execute program instructions to read inputs received from high accuracy real-time clock 18-2. Microcontroller 18-5 is also configured to execute program instructions to facilitate bi-directional communications, e.g., using a communication protocol, such as USB or UART, with power/digital/analog interface 18-1, audit data storage memory 18-3 and secure information memory 18-4.

Electronic dial ring base 30 includes a USB hub circuit board 50 communicatively coupled to USB switch 36-2, and with each of the plurality of USB ports 54-1, 54-2, 54-3. More particularly, USB hub circuit board 50 is configured to operate under the USB communication protocol, and to route USB data between one or more of the USB ports 54-1, 54-2, 54-3 and the USB switch 36-2 of electrical controller circuit board 36.

Advantageously, by using the USB communication protocol to facilitate data communication between user interface 24 and lock assembly 18, the system accommodates transfers of megabytes or even gigabytes of data between user interface 24 and lock assembly 18. In the present configuration, electrical controller circuit board 36 of user interface 24 is the USB Host in the system and lock assembly 18 is a USB device, e.g., a target communications device, in the system.

The present configuration also allows for alternative communication with lock assembly 18 serving as a USB device when, for example, USB port 24-1 of user interface 24 is plugged into a host personal computer (PC). As such, lock assembly 18 may now be controlled via a PC connection using software packages, e.g., lock audit software, such as those available from Sargent and Greenleaf, Inc., instead of using the digital user interface 24 as the user interface.

It is contemplated that in the vast majority of applications, a container, such as container 12, e.g., a safe, which utilizes electromechanical lock 10 will be a standalone system that operates on battery power.

In accordance with another aspect of the present invention, electromechanical lock 10 is configured to extend battery life and conserve battery power. Most of the time, the electronics system of electromechanical lock 10 runs in an idle state until a user initiates a procedure in the system by pressing a button on user interface 24. When the system is idle, to maintain the required battery life, the circuit and microcontrollers in the system need to drop into standby modes where the power consumption of the system drops to near zero. This is to provide as little load on the batteries 40-1, 40-2 as possible when not in use and, thus, increase the battery life of the system. To drop into the standby modes, the digital clocks running the microcontrollers need to be shutdown to reduce the standby power consumption. An event in the system has the capability to wake up the system from the standby mode and resume digital clocks, and thus resume execution of the firmware in the microcontrollers 18-5, 36-1.

USB communication between lock assembly 18 and user interface 24 introduces several issues which in the prior art would either disallow the ability to drop into standby mode, or increase the power consumption when in standby mode. As per the USB specifications, a packet of information is transferred between the USB host (electrical controller circuit board 36 of user interface 24) and the USB device (lock assembly 18) every one millisecond, such that there is always activity on the USB serial data bus. This continuous communication prevents user interface 24 and lock assembly 18 from going to sleep because the USB host needs to initiate the communication and the USB device needs to receive the communication. There is a suspend procedure in the USB specification that terminates the continuous communication. Electrical controller circuit board 36 (USB host) of user interface 24 may suspend the communication and lock assembly 18 (USB device) can detect that the communication is suspended, then both the USB host and the USB device can enter their respective standby modes.

Even when communication is suspended, however, USB communication transfers data using a differential pair of signals such that one signal is always a logic level high and the other is a logic level low. These lines are the D+ and D− data lines. A USB device identifies itself as present to the USB host by pulling one of the data lines to a logic level high through a resistor with a specific value. For a full speed USB device, the D+ line is pulled high by the USB device. When the lock pulls this line high to signal the USB host to its presence, the load provided by the USB host introduces a voltage drop across this resistor. This causes extra standby power consumption even when the USB host and device are allowed to enter standby modes.

Generally, microcontrollers have the ability to wake up from low power standby modes based on events, such as when a general purpose input/output (GPIO) pin changes voltage from high to low, or an internal timer generates a time based event, or serial data is received on a serial port. In these low power modes, the USB hardware on the chip is shutdown typically and cannot wake up from lower power modes based on data sent from a USB host to the USB device. Also, a USB host always initiates communication in the USB specification, so a USB device would not be able to wake up the USB host unless the USB host is already running.

This increase in power consumption was too much to allow and maintain the required battery life of the system, and the current specifications of USB communication and how microcontrollers typically handle USB on chip hardware preclude a standard solution to resume operation if in a low power standby mode.

In accordance with the present invention, a solution was required that would allow electrical controller circuit board 36 (USB host) of user interface 24 and lock assembly 18 (USB device) to enter standby power modes at acceptable standby power consumption levels while also having the ability to wake up the system based on an event at user interface 24 or in lock assembly 18. The solution also allows lock assembly 18 to be able to connect to an external computing device, such as a PC, where the PC is not easily capable of suspending the continuous USB communication. The solution also handles all the different powered scenarios and cable disconnect conditions such that are possible, since power can enter the system from user interface 24 or lock assembly 18, or both, and the user could disconnect the communication cable between devices at any time.

This aspect of the present invention may be applied to any embedded system USB host and embedded system USB device that communicate to each other but when desired, can suspend communication, and either or both system component(s) can enter a low power consumption standby mode until the system wakeup is triggered by either component. The USB device may or may not also be allowed to be attached to a PC for communication.

This aspect of the present invention maintains communication between either the USB host PC or user interface 24 with the lock assembly 18, while also allowing the USB host user interface 24 and lock assembly 18 embedded systems to enter standby low power modes when appropriate. When the USB host is a PC, the PC is always powered on and continuously communicating with USB devices. The actions of the USB host described in this method does not pertain to a PC host and only affects the actions of the USB device (lock assembly 18) where lock assembly 18 must maintain communication with the PC when a PC host is detected.

In the present invention, both lock assembly 18 and electrical controller circuit board 36 of user interface 24 have the ability to either detect the state of the D+ and D-data lines of the USB connection or to set the state of the D+ and D− data lines in some conditions. The USB hardware in microcontroller 18-5 of lock assembly 18 and in microcontroller 36-1 of electrical controller circuit board 36 is responsible for managing the data lines in normal USB operation to transmit/receive data.

In particular, the D+ and D− lines are connected to the USB hardware on microcontrollers 18-5, 36-1, but are also connected into separate GPIO pins of the respective microcontrollers 18-5, 36-1 that have no affect on the data lines when USB communication is occurring. The D− line is connected directly to a GPIO and the D+ line is connected to a GPIO through a pull up resistor at a value specified by the USB specification. A pull up resistor for a USB device on the D+ data line indicates to the USB host that the USB device is a USB full speed device and can communicate at that specified speed. With these GPIO connections, microcontrollers 18-5, 36-1 can now read the state of those lines or set the state of the lines to either a high voltage or low voltage level. Typically the D+ line is only pulled high on the USB device, but the method will require the USB host to be in control of the USB device's pull up at some point so the pull up is placed on both the USB host and the USB device. Care must be taken on the printed circuit boards to ensure that the addition of these connections to the USB data lines does not affect the signal integrity of the USB communication and the robustness of the system.

When electromechanical lock 10 is connected to a PC serving as the USB host, there can be two different power conditions of lock assembly 18. The first is when lock assembly 18 is powered by the USB 5V VBus power source supplied by the PC. The second is the lock assembly 18 is connected to external power and only communicates to the PC via the USB data lines.

When lock assembly 18 is powered by the PC, power is asserted when the USB device is plugged into the PC. Lock assembly 18 on power up pulls the D+ data line high through a resistor to identify itself to the PC initially and the PC connects to the USB device and is continuously communicating with lock assembly 18. Lock assembly 18 will remain in the powered on and running state and will never be allowed to enter the low power standby mode. When powered by the PC, lock assembly 18 is not required to enter low power standby modes because battery usage is not a concern. When the PC is disconnected, lock assembly 18 will be powered down.

When lock assembly 18 is powered by an external power source, it is possible for lock assembly 18 to be executing firmware while not connected to a USB host. Lock assembly 18 pulls up the D+ data line through a resistor to identify itself to the USB host. After a significant timeout period, lock assembly 18 will be allowed to fall into a low power standby mode and the pull up resistor will be disconnected. If the PC is connected before the timeout period expires, lock assembly 18 will be connected to the PC and will again be prevented from entering a low power standby mode to handle continuous communication with the PC.

If the PC is connected after the timeout period has expired, lock assembly 18 will detect the presence of the PC by detecting the 5V V Bus power input from the USB connection provided by the PC and wakeup from the low power standby mode and again pull up the D+ data line through a resistor to identify itself to a host. At this point the PC will connect to lock assembly 18, and lock assembly 18 will be prevented from entering the low power standby mode to handle continuous communication with the PC.

When externally connected and after the PC host has connected with lock assembly 18 and communication is occurring, lock assembly 18 will detect the removal of the PC by the lack of presence of the 5V VBus power input from the PC. When this condition is detected, lock assembly 18 remains powered from the external source but will reinitialize the timeout period for connection to a USB host before entering low power standby mode.

When lock assembly 18 is connected to electrical controller circuit board 36 of user interface 24, serving as the USB host, there are several power conditions for lock assembly 18 to consider as well: user interface 24 may be powered and source power down to the lock assembly 18; lock assembly 18 may be powered and source power up to user interface 24; or user interface 24 and lock assembly 18 may be powered independently. In any of these scenarios, it is desirable for lock assembly 18 and user interface 24 to both have the ability to enter low power standby modes since any power source may most likely be battery powered. This is possible since the present system is not limited by the continuous communication requirement enforced by PC USB hosts.

It is necessary to describe several conditions that each component can communicate to the other in this type of system. Electrical controller circuit board 36 of user interface 24 as a host can send a Wakeup signal to lock assembly 18 indicating the lock assembly 18 is to wake up from low power standby mode. Electrical controller circuit board 36 of user interface 24 can also send a Communication Reset signal to lock assembly 18 to indicate to lock assembly 18 to reset USB communications to allow user interface 24 to re-enumerate lock assembly 18 as a USB device. Lock assembly 18 can also send a Data Available signal to user interface 24 to indicate to user interface 24 to wake from lower power standby mode and resume USB communication to complete a pending data transaction from lock assembly 18 to user interface 24.

The Wakeup signal from electrical controller circuit board 36 of user interface 24 to lock assembly 18 consists of electrical controller circuit board 36 pulling the D+ line high through a pull up resistor on the electrical controller circuit board 36 circuit while outputting a pulse on the D− line to lock assembly 18. Lock assembly 18 wakes up on the pulse on the D− line and sees the high condition on the D+ line and will know that user interface 24 requests to resume communication.

Electrical controller circuit board 36 of user interface 24 can also send the Communication Reset signal to lock assembly 18, which is the same as the Wakeup signal except the D+ data line is not pulled high. When lock assembly 18 wakes up on the D-line pulse and sees the low condition on the D+ data line, it will reset communication.

Lock assembly 18 can send the Data Available signal to the USB host which is a short pulse on the D− line with the D+ line in any state.

When lock assembly 18 is powered on, it is not enumerated to a USB host and it will start up with the D+ line pulled high through pull a up resistor on the lock assembly 18 circuit and will also send a Data Available signal to the USB host to wake it up if user interface 24 is asleep. After a significant timeout period, without being enumerated to a USB host, lock assembly 18 will be allowed to enter the low power standby mode. If lock assembly 18 is enumerated to a USB host during the timeout period, it will continue to pull up the D+ line and remain awake until the USB host identifies itself as local USB host via a data communication or some other signaling condition on the D+ and/or D− data lines. Then, lock assembly 18 is enumerated, but will not pull up the D+ data line. It will be the responsibility of electrical controller circuit board 36 (USB host) of user interface 24 to pull this data line high when communication is desired. Lock assembly 18 will be allowed to enter lower power standby mode when it detects that the USB host is not pulling the D+ data line high. If lock assembly 18 is not enumerated during this timeout period and enters low power standby mode, it will be awakened by the presence detection of a USB host (e.g., electrical controller circuit board 36 of user interface 24) by the presence of a voltage on the VBus power input on the USB connector or by a Wakeup or Communication Reset signal sent from user interface 24. When lock assembly 18 wakes up and is not enumerated, it will pull the D+ line high again and the timeout period will be reset.

This enumeration/identification procedure is repeated on power up of lock assembly 18 or upon reception of a Communication Reset signal from electrical controller circuit board 36 of user interface 24 or any other method of reinitializing communication.

Once enumerated and identified, if both lock assembly 18 and user interface 24 enter low power standby modes, all USB data signals are low to reduce standby power consumption. From this state, if lock assembly 18 would like to communicate data to the USB host, then lock assembly 18 sends the Data Available signal to electrical controller circuit board 36 of user interface 24 and user interface 24 pulls the D+ line high through a pull up resistor, resumes USB communication until the transaction is complete, then lets the D+ line go back low so that the USB host and the USB device may enter standby mode when appropriate. From this state, if user interface 24 would like to communicate data to lock assembly 18, electrical controller circuit board 36 of user interface 24 sends the Wakeup signal to lock assembly 18, which pulls the D+ data line high through a pull up resistor, and resumes USB communication to transfer data to lock assembly 18 for processing. Then, electrical controller circuit board 36 of user interface 24 lets the D+ line go low so that the USB host and the USB device may enter standby mode when appropriate.

If an error is detected by lock assembly 18, where it desires to communicate to user interface 24 but user interface 24 does not complete the transaction within a period of time, then lock assembly 18 will re-initialize communications as described above which will essentially disconnect it from the USB host (electrical controller circuit board 36 of user interface 24). It will be the responsibility of electrical controller circuit board 36 of user interface 24 to re-enumerate itself to the USB device (lock assembly 18). If an error is detected by the USB host where it desires to communicate data to lock assembly 18 but the lock assembly 18 does not complete the transaction within a period of time, then electrical controller circuit board 36 of user interface 24 will send the Communication Reset signal to lock assembly 18 and attempt to re-enumerate to lock assembly 18.

When electrical controller circuit board 36 of user interface 24 is attempting to enumerate the lock assembly 18, the Communication Reset signal is sent to lock assembly 18 periodically until a significant timeout period has elapsed, or until lock assembly 18 pulls the D+ line high to identify itself to electrical controller circuit board 36 of user interface 24. If electrical controller circuit board 36 of user interface 24 is not identified before the timeout period, electrical controller circuit board 36 of user interface 24 will be allowed to enter low power standby mode. If lock assembly 18 is attached or wishes to communicate, it will be responsible for sending the Data Available signal to user interface 24. If electrical controller circuit board 36 of user interface 24 detects this condition but does not have a lock enumerated, it will repeat the procedure in attempt to enumerate lock assembly 18.

In summary, the USB connection between the USB host and lock assembly 18 not only performs USB communication, but also now multiplexes the data lines to perform system wake up signals from one device to the other, communication handshaking to alert the opposite device when data is occurring, and also to relay reset conditions.

The desired effect of this aspect of the present invention will be such that under normal conditions, lock assembly 18 and user interface 24 detect when not connected to each other and attempt initially to reset the opposite device until they synchronize and are connected. Then, when communication is desired in any direction, the components wake the opposite component, communicate, then communication is suspended to allow the components to enter low power standby mode. This procedure is repeated if an error is detected or any other case where either electrical controller circuit board 36 of user interface 24 or lock assembly 18 detects that it is no longer properly enumerated to one another.

All the signaling required by this aspect of the present invention is handled using the standard USB connections. This allows lock assembly 18 to be connected to any USB host using the standard USB cables. Additional conductors besides the USB connection may be used for the wake up/handshaking/signaling schema, but this method does not require them. The method could be easily modified to add one to two additional conductors for those purposes.

This method may be apply to any system with embedded system type USB Host and USB Devices that communicate with one another and desire to enter some type of power saving mode. This method also allows for the USB Device to be connected to a PC as set forth by the USB specifications.

Advantageously, USB communication between the embedded system USB host and the USB device is provided while still maintaining the ability to enter standby/sleep/low leakage states in the microcontrollers for power saving. Also, advantageously, the system of the present invention maintains the ability for a USD device using the method to operate seamlessly with a USB Host that enforces the USB specifications (i.e., a PC based Host). The method uses standard USB connections for power, ground, and the D+ and D− data lines, while allowing capability for entering low power standby modes and also can be connected to standard USB Hosts using standard USB cables.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A high security electromechanical lock, comprising:

a lock assembly configured to extend or retract a locking member, the lock assembly including a first microcontroller communicatively coupled to an electronic storage memory; and an electronic key input assembly electrically and mechanically coupled to the lock assembly, the electronic key input assembly including an electronic dial ring base having a base plate and a communications hub circuit mounted to the base plate, the base plate having a side wall, the communications hub circuit having a plurality of communications ports arranged around a periphery of the base plate and accessible through the side wall, each of the plurality of communications ports being configured to communicate with a respective peripheral electronic device of a plurality of peripheral electronic devices, and the base plate configured to mechanically removably mount each of the plurality of peripheral electronic devices around the periphery of the side wall of the base plate.

2. The high security electromechanical lock of claim 1, wherein the side wall of the base plate has a circular shape and has a plurality of side windows that correspond to respective locations of each of the plurality of communications ports.

3. The high security electromechanical lock of claim 2, wherein each of the plurality of side windows is configured to be covered by a respective annular cover clip in the absence of the respective peripheral electronic device, the respective annular cover clip having a pair of mounting tabs which deflect when inserted into the side window to retain the cover clip in position on the electronic dial ring base.

4. The high security electromechanical lock of claim 2, wherein the plurality of communications ports and the corresponding plurality of side windows are located at equal angular increments around the periphery of the side wall of the base plate of the electronic dial ring base.

5. The high security electromechanical lock of claim 1, wherein each of the plurality of peripheral devices is one of an iButton® Reader, a biometric fingerprint scanner, a Bluetooth receiver, and an Ethernet adapter.

6. The high security electromechanical lock of claim 1, the electronic key input assembly further including:

a main body mounted to the electronic dial ring base;

a user interface coupled to the main body;

an electrical controller circuit board mounted to the main body, the electrical controller circuit board being communicatively coupled to the user interface, the electrical controller circuit board including a second microcontroller and a communications control circuit configured to direct bi-directional communication traffic with the first microcontroller of the lock assembly and with each of the second microcontroller and the communications hub circuit of the electronic key input assembly.

7. The high security electromechanical lock of claim 6, wherein the communications control circuit is a USB switch, the communications hub circuit is a USB hub circuit board, and the plurality of communications ports is a plurality of USB ports, the USB hub circuit board configured to operate under a USB communication protocol and configured to route USB data between one or more of the USB ports of the USB hub circuit and the USB switch of the electrical controller circuit board.

8. The high security electromechanical lock of claim 6, the electronic key input assembly further including a bezel mounted to the main body, the bezel configured to rotate about an operational axis relative to the main body to actuate the lock assembly and configured for axial movement along the operational axis relative to the main body to expose a battery receptacle formed in the main body.

9. The high security electromechanical lock of claim 8, wherein the bezel is configured as a rigid ring that includes an annular side wall having an interior surface, and having at least one roller assembly attached to the interior surface of the annular side wall, wherein each roller assembly is configured to serve as a bearing and as a connection with the main body of the electronic key input assembly.

10. The high security electromechanical lock of claim 9, wherein each roller assembly includes a roller carrier body configured as a yoke in which a pair of rollers is rotatably and flexibly mounted, with each roller of the pair of rollers being mounted to a respective axle, wherein opposing ends of the respective axle are respectively received in a pair of opposed slotted openings in the roller carrier body, and with each roller being spring biased outwardly from a radial center of the roller carrier body by a spring, such that the pair of rollers are flexible in an annular angular range at a location radially spaced from the operational axis.

11. The high security electromechanical lock of claim 9, wherein the main body has a periphery and includes, for each roller assembly, a respective exterior guide channel at the periphery, each exterior guide channel configured to cooperate with a respective roller assembly to limit rotational and axial motion of the bezel relative to the main body.

12. The high security electromechanical lock of claim 11, wherein each exterior guide channel has an L-shape, and includes an axial channel portion and an annular channel portion, each of the axial channel portion and the annular channel portion being radially spaced from the operational axis, the axial channel portion being located at an open end of the annular channel portion such that the axial channel portion is continuous with the annular channel portion.

13. The high security electromechanical lock of claim 12, wherein each exterior guide channel is configured to permit an axial movement of the bezel relative to the main body only when the pair of rollers of the respective roller assembly of the bezel is in axial alignment with the respective axial channel portion of the main body, and wherein opposed side walls of each axial channel portion restrains rotational movement of the bezel when the bezel is moved axially from an axially retracted position to an axially extended position.

14. The high security electromechanical lock of claim 13, wherein each exterior guide channel is configured to facilitate rotational movement of the bezel about the operational axis only when the bezel is in the axially retracted position such that the pair of rollers of the respective roller assembly of the bezel is rotationally aligned with the respective annular channel portion of the main body.

15. The high security electromechanical lock of claim 13, wherein each roller of the pair of rollers of each respective roller assembly has a spring that engages each roller to bias each roller of the pair of rollers outwardly, and the opposed side walls of the axial channel portion of each respective guide channel are spaced to engage and inwardly collapse the respective pair of rollers of the respective roller assembly, the respective pair of rollers configured to expand when the respective pair of rollers are axially positioned beyond the axial extent of an inner side wall of the opposed side walls of the respective axial channel portion, the respective pair of rollers remaining in contact with the main body to form a respective axial detent at each of the axially retracted position and the axially extended position of the bezel.

16. The high security electromechanical lock of claim 8, wherein the battery receptacle includes a battery chamber having a battery retention clip which serves as a door to radially retain a battery in the battery chamber, the battery retention clip being formed of a continuous length of wire, bent to form two arcuate portions joined at their respective distal ends by a connecting portion, and with two free proximal ends being bent in opposing directions to form a pair of rotational axles, the two free proximal ends being received in corresponding pivot openings formed in the main body, and wherein the two arcuate portions of the battery retention clip are configured to engage a proximal end of the battery, and with the arcuate portion closest to a floor of the main body configured to engage a latch formed in the floor of the main body to retain the battery in the battery chamber.

17. The high security electromechanical lock of claim 8, wherein the battery receptacle includes a plurality of battery chambers, each battery chamber having a battery retention clip which serves as a door to radially retain a respective battery in the respective battery chamber, wherein each battery retention clip is pivotably mounted to a proximal end of a dividing wall between the plurality of battery chambers, wherein each battery retention clip is formed of a continuous length of wire, bent to form two arcuate portions joined at their respective distal ends by a straight connecting portion, and with two free proximal ends being bent in opposing directions to form a pair of axially arranged rotational axles, the two free proximal ends being received in corresponding pivot openings formed at the proximal end of the dividing wall, and wherein the two arcuate portions of the respective battery retention clip are configured to engage a proximal end of the respective battery, and with the arcuate portion closest to a floor of the main body configured to engage a latch formed in the floor of the main body to retain the respective battery in the respective battery chamber.

18. The high security electromechanical lock of claim 1, the electronic key input assembly further including:

a user interface coupled to the main body; and an electrical controller circuit board mounted to the main body, the electrical controller circuit board being communicatively coupled to the user interface, the electrical controller circuit board including a second microcontroller and a communications control circuit configured to direct bi-directional communication traffic with the first microcontroller of the lock assembly and with each of the second microcontroller and the communications hub circuit of the electronic key input assembly, wherein the electrical controller circuit board is defined as a USB host and the lock assembly is defined as a USB device, and wherein the USB host and the USB device are configured to communicate with each other via a standard USB connection and configured to suspend USB communication during a standby mode for low power consumption, and configured such that either or both of the USB host and the USB device can enter the standby mode until a wakeup is triggered by either of the USB host and the USB device.

19. The high security electromechanical lock of claim 18, wherein pin connections to each of the first microcontroller and second microcontroller are modified to multiplex the USB data lines D+ and D− to supply wake up signals from one of the USB host and the USB device to the other, to facilitate communication handshaking to alert the opposite one of the USB host and the USB device when data transfer is occurring, and to relay reset conditions.

20. The high security electromechanical lock of claim 18, wherein when the USB host triggers the wakeup, the USB host is configured to send a Wakeup signal to the USB device to indicate that the USB device is to wake up from the low power standby mode, the USB host further configured to send a Communication Reset signal to the USB device to indicate to the USB device to reset the USB communications to allow the USB host to re-enumerate the USB device.

21. The high security electromechanical lock of claim 20, wherein the Wakeup signal from the USB host to the USB device includes the electrical controller circuit board pulling a D+ line of the USB connection high through a pull up resistor on the electrical controller circuit board while outputting a pulse on the D− line of the USB connection to the USB device, therein the USB device wakes up on the pulse on the D− line and sees the high condition on the D+ line and determines that the USB host desires to resume communication.

22. The high security electromechanical lock of claim 18, wherein when the USB device triggers the wakeup, the USB device is configured to send a Data Available signal to the USB host to wake the USB host from the lower power standby mode and resume USB communication to complete a pending data transaction from the USB device to the USB host.

23. A high security electromechanical lock, comprising:

a lock assembly configured to extend or retract a locking member; and an electronic key input assembly electrically and mechanically coupled to the lock assembly, the electronic key input assembly including a main body and a bezel mounted to the main body, the bezel configured to rotate about an operational axis when the bezel is in an axially retracted position relative to the main body to actuate the lock assembly and configured for axial movement along the operational axis relative to the main body when the bezel is in a first rotational position relative to the main body to expose a battery receptacle formed in the main body.

24. The high security electromechanical lock of claim 23, wherein the bezel is configured as a rigid ring that includes an annular side wall having an interior surface, and having at least one roller assembly attached to the interior surface of the annular side wall.

25. The high security electromechanical lock of claim 24, wherein each roller assembly includes a roller carrier body configured as a yoke in which a pair of rollers is rotatably and flexibly mounted, with each roller of the pair of rollers being mounted to a respective axle, wherein opposing ends of the respective axle are respectively received in a pair of opposed slotted openings in the roller carrier body, and with each roller being spring biased outwardly from a radial center of the roller carrier body by a spring, such that the pair of rollers are flexible in an annular angular range at a location radially spaced from the operational axis.

26. The high security electromechanical lock of claim 24, wherein the main body has a periphery and includes, for each roller assembly, a respective exterior guide channel at the periphery, each exterior guide channel configured to cooperate with a respective roller assembly to limit rotational and axial motion of the bezel relative to the main body.

27. The high security electromechanical lock of claim 26, wherein each exterior guide channel has an L-shape, and includes an axial channel portion and an annular channel portion, each of the axial channel portion and the annular channel portion being radially spaced from the operational axis, the axial channel portion being located at an open end of the annular channel portion such that the axial channel portion is continuous with the annular channel portion.

28. The high security electromechanical lock of claim 27, wherein each exterior guide channel is configured to permit an axial movement of the bezel relative to the main body only when the pair of rollers of the respective roller assembly of the bezel is in axial alignment with the respective axial channel portion of the main body, and wherein opposed side walls of each axial channel portion restrains rotational movement of the bezel when the bezel is moved axially from an axially retracted position to an axially extended position.

29. The high security electromechanical lock of claim 28, wherein each exterior guide channel is configured to facilitate rotational movement of the bezel about the operational axis only when the bezel is in the axially retracted position such that the pair of rollers of the respective roller assembly of the bezel is rotationally aligned with the respective annular channel portion of the main body.

30. The high security electromechanical lock of claim 28, wherein each roller of the pair of rollers of each respective roller assembly has a spring that engages each roller to bias each roller of the pair of rollers outwardly, and the opposed side walls of the axial channel portion of each respective guide channel are spaced to engage and inwardly collapse the respective pair of rollers of the respective roller assembly, the respective pair of rollers configured to expand when the respective pair of rollers are axially positioned beyond the axial extent of an inner side wall of the opposed side walls of the respective axial channel portion, the respective pair of rollers remaining in contact with the main body to form a respective axial detent at each of the axially retracted position and the axially extended position of the bezel.

31. The high security electromechanical lock of claim 23, wherein the battery receptacle includes a battery chamber having a battery retention clip which serves as a door to radially retain a battery in the battery chamber, the battery retention clip being formed of a continuous length of wire, bent to form two arcuate portions joined at their respective distal ends by a connecting portion, and with two free proximal ends being bent in opposing directions to form a pair of rotational axles, the two free proximal ends being received in corresponding pivot openings formed in the main body, and wherein the two arcuate portions of the battery retention clip are configured to engage a proximal end of the battery, and with the arcuate portion closest to a floor of the main body configured to engage a latch formed in the floor of the main body to retain the battery in the battery chamber.

32. The high security electromechanical lock of claim 23, wherein the battery receptacle includes a plurality of battery chambers, each battery chamber having a battery retention clip which serves as a door to radially retain a respective battery in the respective battery chamber, wherein each battery retention clip is pivotably mounted to a proximal end of a dividing wall between the plurality of battery chambers, wherein each battery retention clip is formed of a continuous length of wire, bent to form two arcuate portions joined at their respective distal ends by a straight connecting portion, and with two free proximal ends being bent in opposing directions to form a pair of axially arranged rotational axles, the two free proximal ends being received in corresponding pivot openings formed at the proximal end of the dividing wall, and wherein the two arcuate portions of the respective battery retention clip are configured to engage a proximal end of the respective battery, and with the arcuate portion closest to a floor of the main body configured to engage a latch formed in the floor of the main body to retain the respective battery in the respective battery chamber.

33. The high security electromechanical lock of claim 23, comprising:

a plurality of peripheral electronic devices; and an electronic dial ring base coupled to the main body, the electronic dial ring base having a base plate and a communications hub circuit mounted to the base plate, the base plate having a side wall with a plurality of side windows, the communications hub circuit having a plurality of communications ports arranged around a periphery of the base plate, each communication port of the plurality of communication ports being located at and accessible through a respective side window of the plurality of side windows of the base plate, and each of the plurality of communications ports being configured to communicate with a respective peripheral electronic device of the plurality of peripheral electronic devices, and the base plate configured to mechanically removably mount each of the plurality of peripheral electronic devices around the periphery of the side wall of the base plate.

34. The high security electromechanical lock of claim 33, wherein each of the plurality of side windows is configured to be covered by a respective annular cover clip in the absence of the respective peripheral electronic device, the respective annular cover clip having a pair of mounting tabs which deflect when inserted into the side window to retain the cover clip in position on the electronic dial ring base.

35. The high security electromechanical lock of claim 33, wherein the plurality of communications ports and the corresponding plurality of side windows are located at equal angular increments around the periphery of the side wall of the base plate of the electronic dial ring base.

36. The high security electromechanical lock of claim 35, wherein the number of the plurality of communications ports is three and the equal angular increments is 120 degrees.

37. The high security electromechanical lock of claim 35, wherein each of the plurality of peripheral devices is one of an iButton® Reader, a biometric fingerprint scanner, a Bluetooth receiver, and an Ethernet adapter.

38. The high security electromechanical lock of claim 33, wherein:

the lock assembly including a first microcontroller communicatively coupled to an electronic storage memory; and the electronic key input assembly further including:

a user interface coupled to the main body;

an electrical controller circuit board mounted to the main body, the electrical controller circuit board being communicatively coupled to the user interface, the electrical controller circuit board including a microcontroller and a communications control circuit configured to direct bi-directional communication traffic with the lock assembly and with each of the microcontroller and the communications hub circuit of the electronic key input assembly.

39. The high security electromechanical lock of claim 38, wherein the communications control circuit is a USB switch, the communications hub circuit is a USB hub circuit board, and the plurality of communications ports is a plurality of USB ports, the USB hub circuit board configured to operate under a USB communication protocol and configured to route USB data between one or more of the USB ports of the USB hub circuit and the USB switch of the electrical controller circuit board.

40. The high security electromechanical lock of claim 33, wherein:

the lock assembly including a first microcontroller communicatively coupled to an electronic storage memory; and the electronic key input assembly further including:

a user interface coupled to the main body; and an electrical controller circuit board mounted to the main body, the electrical controller circuit board being communicatively coupled to the user interface, the electrical controller circuit board including a second microcontroller and a communications control circuit configured to direct bi-directional communication traffic with the first microcontroller of the lock assembly and with each of the second microcontroller and the communications hub circuit of the electronic key input assembly, wherein the electrical controller circuit board is defined as a USB host and the lock assembly is defined as a USB device, and wherein the USB host and the USB device are configured to communicate with each other via a standard USB connection and configured to suspend USB communication during a standby mode for low power consumption, and configured such that either or both of the USB host and the USB device can enter the standby mode until a wakeup is triggered by either of the USB host and the USB device.

41. The high security electromechanical lock of claim 40, wherein pin connections to each of the first microcontroller and second microcontroller are modified to multiplex the USB data lines D+ and D− to supply wake up signals from one of the USB host and the USB device to the other, to facilitate communication handshaking to alert the opposite one of the USB host and the USB device when data transfer is occurring, and to relay reset conditions.

42. The high security electromechanical lock of claim 40, wherein when the USB host triggers the wakeup, the USB host is configured to send a Wakeup signal to the USB device to indicate that the USB device is to wake up from the low power standby mode, the USB host further configured to send a Communication Reset signal to the USB device to indicate to the USB device to reset the USB communications to allow the USB host to re-enumerate the USB device.

43. The high security electromechanical lock of claim 42, wherein the Wakeup signal from the USB host to the USB device includes the electrical controller circuit board pulling a D+ line of the USB connection high through a pull up resistor on the electrical controller circuit board while outputting a pulse on the D− line of the USB connection to the USB device, therein the USB device wakes up on the pulse on the D− line and sees the high condition on the D+ line and determines that the USB host desires to resume communication.

44. The high security electromechanical lock of claim 40, wherein when the USB device triggers the wakeup, the USB device is configured to send a Data Available signal to the USB host to wake the USB host from the lower power standby mode and resume USB communication to complete a pending data transaction from the USB device to the USB host.

45. A high security electromechanical lock, comprising:

a lock assembly configured to extend or retract a locking member, the lock assembly including a first microcontroller communicatively coupled to an electronic storage memory, the lock assembly being configured for data communications via a standard communications protocol as a target communications device; and an electronic key input assembly electrically and mechanically coupled to the lock assembly, the electronic key input assembly including:

an electronic dial ring base having a base plate and a communications hub circuit mounted to the base plate, the a main body coupled to the electronic dial ring base;

a bezel mounted to the main body, the bezel configured to rotate about an operational axis relative to the main body to actuate the lock assembly;

a user interface coupled to the main body; and an electrical controller circuit board mounted to the main body, the electrical controller circuit board being configured for data communications via the standard communications protocol as a communications host and is communicatively coupled to the user interface, the electrical controller circuit board including a second microcontroller and a communications control circuit configured to direct bi-directional communication traffic with the first microcontroller of the lock assembly and with each of the second microcontroller and the communications hub circuit of the electronic key input assembly, wherein the communications host and the target communications device are configured to communicate with each other via a standard communications connection compatible with the standard communications protocol and configured to suspend communication during a standby mode for low power consumption, and configured such that either or both of the communications host and the target communications device can enter the standby mode until a wakeup is triggered by either of the communications host and the target communications device.

46. The high security electromechanical lock of claim 45, wherein the target communications device is a USB device and the communications host is a USB host, and wherein pin connections to each of the first microcontroller and second microcontroller are modified to multiplex the USB data lines D+ and D− to supply wake up signals from one of the USB host and the USB device to the other, to facilitate communication handshaking to alert the opposite one of the USB host and the USB device when data transfer is occurring, and to relay reset conditions.

47. The high security electromechanical lock of claim 46, wherein the target communications device is a USB device and the communications host is a USB host, and wherein when the USB host triggers the wakeup, the USB host is configured to send a Wakeup signal to the USB device to indicate that the USB device is to wake up from the low power standby mode, the USB host further configured to send a Communication Reset signal to the USB device to indicate to the USB device to reset the USB communications to allow the USB host to re-enumerate the USB device.

48. The high security electromechanical lock of claim 47, wherein the Wakeup signal from the USB host to the USB device includes the electrical controller circuit board pulling a D+ line of the USB connection high through a pull up resistor on the electrical controller circuit board while outputting a pulse on the D− line of the USB connection to the USB device, therein the USB device wakes up on the pulse on the D− line and sees the high condition on the D+ line and determines that the USB host desires to resume communication.

49. The high security electromechanical lock of claim 45, wherein the target communications device is a USB device and the communications host is a USB host, and wherein when the USB device triggers the wakeup, the USB device is configured to send a Data Available signal to the USB host to wake the USB host from the lower power standby mode and resume USB communication to complete a pending data transaction from the USB device to the USB host.

* * * * *